US007830329B2

(12) United States Patent
Fukushima et al.

(10) Patent No.: US 7,830,329 B2
(45) Date of Patent: Nov. 9, 2010

(54) COMPOSITE ANTENNA AND PORTABLE TERMINAL USING SAME

(75) Inventors: Susumu Fukushima, Osaka (JP); Motohiko Sako, Osaka (JP)

(73) Assignee: Panasonic Corporation, Osaka (JP)

( * ) Notice: Subject to any disclaimer, the term of this patent is extended or adjusted under 35 U.S.C. 154(b) by 427 days.

(21) Appl. No.: 12/066,968

(22) PCT Filed: Nov. 8, 2006

(86) PCT No.: PCT/JP2006/322254

§ 371 (c)(1),
(2), (4) Date: Mar. 14, 2008

(87) PCT Pub. No.: WO2007/055232

PCT Pub. Date: May 18, 2007

(65) Prior Publication Data

US 2009/0237319 A1 Sep. 24, 2009

(30) Foreign Application Priority Data

Nov. 8, 2005 (JP) ..... 2005-323213
Dec. 1, 2005 (JP) ..... 2005-347644

(51) Int. Cl.
*H01Q 1/48* (2006.01)

(52) U.S. Cl. ..... 343/848; 343/702; 343/893; 343/713

(58) Field of Classification Search ..... 343/848, 343/702, 700 MS, 793, 713, 725, 726, 727, 343/749, 751, 752
See application file for complete search history.

(56) References Cited

U.S. PATENT DOCUMENTS

2002/0190909 A1* 12/2002 Yamamoto et al. ..... 343/742
2003/0189519 A1* 10/2003 Rutfors et al. ..... 343/702
2007/0008228 A1* 1/2007 Yamada et al. ..... 343/702
2007/0024513 A1* 2/2007 Sako ..... 343/727

FOREIGN PATENT DOCUMENTS

JP 49-127545 12/1974
JP 2000-059129 2/2000
JP 2002-359515 12/2002
JP 2003-142935 5/2003
JP 2003-298340 10/2003

OTHER PUBLICATIONS

International Search Report for PCT/JP2006-322254; Feb. 8, 2007.

* cited by examiner

*Primary Examiner*—Douglas W Owens
*Assistant Examiner*—Dien Hien T Duong
(74) *Attorney, Agent, or Firm*—Pearne & Gordon LLP

(57) ABSTRACT

Provided is a composite antenna adapted for reduction in size while ensuring sufficient electrical isolation between antenna elements. The composite antenna comprises ground plane, first feeding point connected to ground plane, first conductor connected to first feeding point and disposed linearly symmetrically with respect to axis, second conductor connected to first conductor and disposed linearly symmetrically with respect to axis, second feeding point disposed in a position along axis, third conductor connecting second feeding point and second conductor, and fourth conductor connecting second feeding point and second conductor and disposed in a linearly symmetrical manner to third conductor with respect to axis.

30 Claims, 16 Drawing Sheets

COMPOSITE ANTENNA AND PORTABLE TERMINAL USING SAME

This application is a U.S. national phase application of PCT international application PCT/JP2006/322254.

TECHNICAL FIELD

The present invention relates to composite antennas used for various kinds of wireless communications devices. The invention also relates to portable terminals using the same.

BACKGROUND ART

In a communications device equipped with a plurality of antenna elements such as a diversity antenna, it is generally important to keep a sufficient electrical isolation between the antenna elements. A composite antenna of such kind is therefore provided with large spaces between antenna elements in order to ensure the electrical isolation between the adjoining elements.

Patent document 1, for instance, is one of the prior art documents known to be relevant to the invention of this patent application. Due to the increasing tendency in recent years toward downsizing of mobile communications terminals such as cellular phones, it has become difficult to keep sufficient spaces between adjoining antenna elements when such composite antennas are mounted, which often results in such circumstances that the electrical isolations are not properly maintainable.

Patent Document 1: Japanese Patent Unexamined Publication, No. 2003-298340

SUMMARY OF THE INVENTION

The present invention is directed to overcome the problems discussed above, and to provide a composite antenna adapted for reduction in size while ensuring the electrical isolation.

The composite antenna according to the present invention comprises a ground plane, a first feeding point connected to the ground plane, a first conductor connected to the first feeding point and having a linearly symmetric configuration or a plane symmetric configuration or electrically symmetric with respect to an axis or a plane orthogonal to the ground plane, a second conductor connected to the first conductor and having a linearly symmetric configuration or a plane symmetric configuration or electrically symmetric with respect to the axis or the plane, a second feeding point set at any given position in the axis or the plane, a third conductor connecting the second feeding point and the second conductor, and a fourth conductor connecting the second feeding point and the second conductor and disposed in a manner that is linearly symmetric or plane symmetric or electrically symmetric to the third conductor with respect to the axis or the plane.

According to the above structure of this invention, the antenna has a symmetrical configuration, in which one antenna element is used as a common element of both a balanced type antenna and an unbalanced type antenna. This helps limit changes in voltage potentials of the balanced type antenna and the unbalanced type antenna with respect to each other at their feeding points, thereby ensuring the electrical isolation properly between the antenna elements. This invention can thus achieve reduction in size of the composite antenna while also ensuring the electrical isolation of the individual antenna elements composing the same.

REFERENCE MARKS IN THE DRAWINGS

Figure 1:
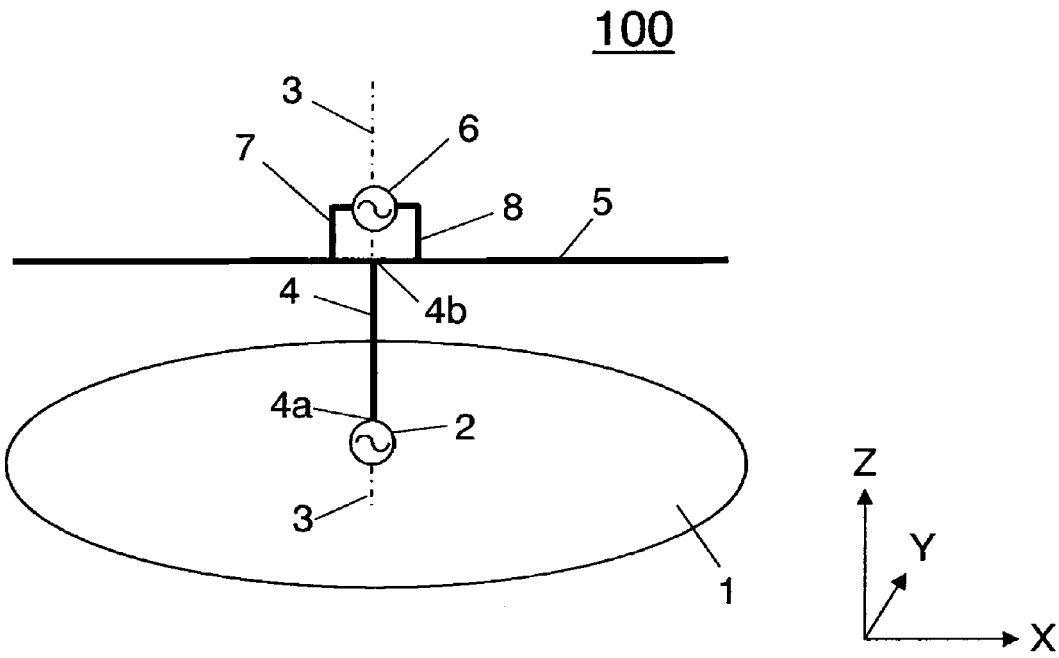
FIG. 1 is a perspective view showing a composite antenna according to a first exemplary embodiment of the present invention.

1 ground plane
2 first feeding point
3 axis
4 first conductor
5 second conductor
6 second feeding point
7 third conductor
8 fourth conductor
17 inductor
18 plane
19 meandering configuration
20 roof plate
21 windshield
22 fifth conductor
23 third feeding point
24 sixth conductor
25 seventh conductor
100, 104, 105, 106, 107, 108, 109A, 109B, 110, 111, 112, 114, 115, 116, 117, 118, 119, 120, 121A, 121B, 122, 123, 124 and 125 composite antenna

DETAILED DESCRIPTION OF PREFERRED EMBODIMENTS

First Exemplary Embodiment

FIG. 1 is a perspective view schematically showing composite antenna 100 according to the first exemplary embodiment of the present invention. A basic structure of composite antenna 100 consists of ground plane 1 having generally a planar shape, first feeding point 2 connected to ground plane 1, and first conductor 4 having one end 4*a* connected to first feeding point 2, first conductor 4 having generally a linearly symmetric configuration with respect to axis 3 which is generally orthogonal to ground plane 1 and disposed in a linearly symmetric manner to axis 3. Axis 3 is located generally in the center of ground plane 1. Composite antenna 100 further comprises second conductor 5 connected to other end 4*b* of first conductor 4 and having a linearly symmetric configuration with respect to axis 3, second feeding point 6 disposed in position along axis 3, third conductor 7 connecting second feeding point 6 and second conductor 5, and fourth conductor 8 also connecting second feeding point 6 and second conductor 5 and disposed in a linearly symmetrical manner to third conductor 7 with respect to axis 3.

Composite antenna 100 functions as an unbalanced type antenna when an electric power is fed through first feeding point 2, i.e., the power is supplied to first feeding point 2. On the other hand, composite antenna 100 also functions as a balanced type antenna when an electric power is fed through second feeding point 6.

Figure 2:
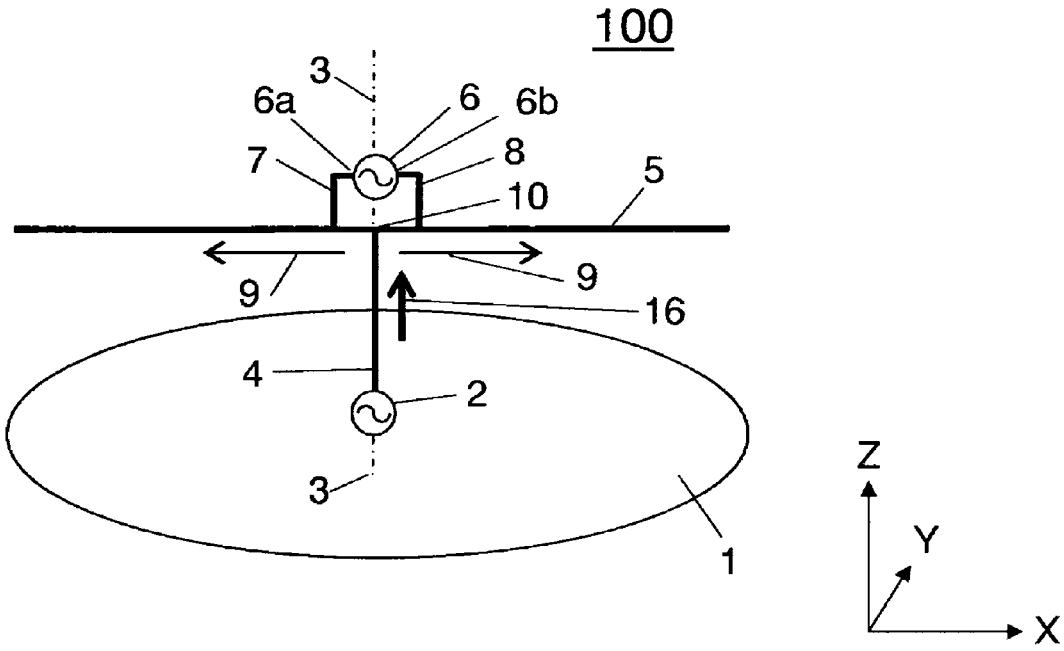
FIG. 2 is a perspective view of the same composite antenna showing a state when an electric power is fed to a first feeding point.
Figure 3:
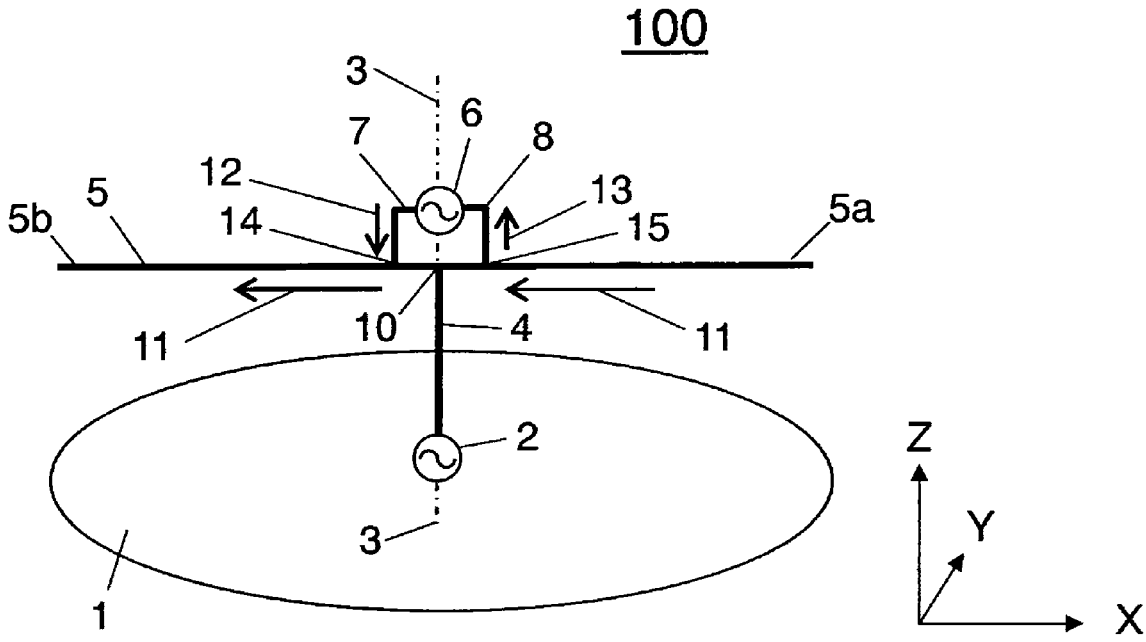
FIG. 3 is a perspective view of the same composite antenna showing another state when an electric power is fed to a second feeding point.

Referring now to FIG. 2 and FIG. 3, description is provided of an operation of composite antenna 100 according to the first exemplary embodiment. The description specifically puts a focus on the reason why the sufficient electrical isolation can be ensured between first feeding point 2 and second feeding point 6.

When an electric power is fed to first feeding point 2 to make composite antenna 100 of FIG. 2 function as an unbalanced type antenna, electric current 9 delivered from first feeding point 2 via first conductor 4 flow through second conductor 5 in the directions away from junction 10 between first conductor 4 and second conductor 5, which are the outward directions, as shown in FIG. 2. For the purpose of simplifying the explanation and the drawing, FIG. 2 shows electric currents 9 as being in the outward directions from junction 10. However, the directions of electric currents 9 change alternately between the outward directions and the inward directions with respect to junction 10 at cyclic durations corresponding to a frequency of the signal supplied to first feeding point 2.

An electromagnetic field coupling of first conductor 4 with second conductor 5 becomes generally linear symmetric about axis 3 since both first conductor 4 and second conductor 5 are so configured and arranged as to be linearly symmetric with respect to axis 3. For this reason, electric currents 9 flow along second conductor 5 in the symmetrical manner about axis 3. In addition, a difference in voltage potential produced by electric currents 9 flowing in the symmetrical manner about axis 3 and appearing between junction 6*a* of second feeding point 6 with third conductor 7 and junction 6*b* of second feeding point 6 with fourth conductor 8 always remains at nearly zero volt because third conductor 7 and fourth conductor 8 are arranged symmetrically with respect to axis 3. Composite antenna 100 constructed as above eliminates electrical interference to second feeding point 6 from first feeding point 2 when it is used as an unbalanced type antenna by feeding electric power to first feeding point 2, thereby ensuring the sufficient electrical isolation between the feeding points.

Using FIG. 3, description is provided next of an operation of composite antenna 100 when it is functioned as a balanced type antenna by feeding an electric power through second feeding point 6. Electric current 11 induced in second conductor 5 flows in one direction from one end 5*a* to the other end 5*b* of second conductor 5. Here, an electromagnetic field coupling of second conductor 5 with first conductor 4 becomes generally linear symmetric about axis 3 since both first conductor 4 and second conductor 5 are arranged linearly symmetrically with respect to axis 3. In addition, voltage distribution along second conductor 5 has such a pattern that it always becomes nearly zero volt at junction 10 between first conductor 4 and second conductor 5 since second conductor 5 is formed into generally a linearly symmetric configuration with respect to axis 3. Accordingly, composite antenna 100 shown in FIG. 1 can eliminate undesired interference to first feeding point 2 from second feeding point 6 when it is used as a balanced type antenna by feeding a high frequency signal to second feeding point 6, thereby ensuring the sufficient electrical isolation between these feeding points.

It was necessary in the conventional structure to provide a sufficient distance from one antenna element to another in order to maintain the electrical isolation properly between the two antenna elements. According to the present invention, however, it becomes possible to reduce the size of composite antenna 100 because it allows a narrower space between the antenna elements. Furthermore, this invention can simplify the structure of composite antenna 100 since it allows two feeding points to share a single antenna element, whereas the conventional structure had required two sets of the antenna element.

Referring to FIG. 3, an impedance matching of the composite antenna at second feeding point 6 can be made by adjusting a distance from junction 10 to junction 14 between second conductor 5 and third conductor 7, as well as a distance from junction 10 to junction 15 between second conductor 5 and fourth conductor 8. This helps make the impedance matching easier as compared with the ordinary dipole antenna positioned in close proximity to ground plane 1.

Description is provided next of a radiating pattern of composite antenna 100 according to the present invention. When a signal is supplied through first feeding point 2, electric current 16 induced in first conductor 4 is the current that contributes to the radiation (refer to FIG. 2). Electric currents 9 induced in second conductor 5 do not influence the radiating pattern greatly because the directions of flow are opposite to each other with respect to junction 10. As a result, the radiating pattern of composite antenna 100 shown in FIG. 1 generally exhibits a non-directional characteristic in the X-Y plane (i.e., polarization in Z-axis), and null points in the directions of ±Z-axis, when the signal is supplied to second feeding point 6.

When a signal is supplied through second feeding point 6, on the other hand, electric current 11 induced in second conductor 5 is the current that contributes to the radiation (see FIG. 3), but no current is induced in first conductor 4 to contribute to the radiation. Furthermore, electric current 12 flowing in third conductor 7 and electric current 13 flowing in fourth conductor 8 are in the directions opposite to each other, so that they do not significantly affect to the radiating pattern when a space between third conductor 7 and fourth conductor 8 is set small relative to the wavelength. As a result, the radiating pattern of composite antenna 100 shown in FIG. 1 exhibits null points in the directions of ±X-axis when the signal is supplied to second feeding point 6. Assuming here that ground plane 1 did not exist, composite antenna 100 would then exhibit no directivity in the Y-Z plane (i.e., polarization in X-axis). In reality however, composite antenna 100 shows the highest gain in the direction of +Z-axis because of the existence of ground plane 1, which reflects the radiation.

As discussed, the radiating patterns produced by the signals supplied from the individual feeding points mutually compensates their null points in the directions of ±X-axis and ±Z-axis. Composite antenna 100 shown in FIG. 1 is useful for such applications as a directional diversity antenna and polarization diversity antenna since it produces two radiating patterns of different polarizations in the directions of ±Y-axis.

In the case of supplying signals of the same frequency to both first feeding point 2 and second feeding point 6, it is possible for the composite antenna to radiate circularly polarized waves in the directions of generally ±Y-axis by properly adjusting phases of the individual signals. The invention can thus achieve a circular polarization antenna capable of radiating circularly polarized waves in the directions of generally ±Y-axis with the small and simple antenna structure shown in FIG. 1. It is also possible to change the directions of radiating the circularly polarized waves by altering ground plane 1 into a variety of different shapes and configurations.

Composite antenna 100 of the present invention shown in FIG. 1 can be used not only as a diversity antenna but also as a duplex antenna for two systems. As a result, the invention can help reduce a number of antennas necessary for cellular phones provided with a variety of different systems, thereby achieving a reduction in size of the cellular phones. Moreover, composite antenna 100 shown in FIG. 1 can also be used as a multiplexer or a part thereof. Since this makes a separate multiplexer unnecessary, it can achieve a further reduction in size of telecommunications devices such as cellular phones. Use of composite antenna 100 shown in FIG. 1 as a part of multiplexer can help design the multiplexer while achieving a low passing loss of the signals. This can improve an NF characteristic of a portable terminal when used as a receiver, and reduce power consumption of a power amplifier when used as a transmitter.

The signals supplied to first feeding point 2 and second feeding point 6 may be of the same frequency or different frequencies. Composite antenna 100, when adapted for handling signals of different frequencies supplied to first feeding point 2 and second feeding point 6, can be used as an antenna of a telecommunications device employing complex systems of various kinds that uses a number of frequencies.

Referring to FIG. 1, the substance of the first exemplary embodiment can be summarized as follows. That is, composite antenna 100 according to the present invention comprises a ground plane (1), a first feeding point (2) connected to the ground plane (1), a first conductor (4) connected to the first feeding point (2) and having a linearly symmetric or plane symmetric configuration with respect to an axis (3) or a plane orthogonal to the ground plane (1), a second conductor (5) connected to the first conductor (4) and having a linearly symmetric or plane symmetric configuration with respect to the axis (3) or the plane, a second feeding point (6) set at any given position in the axis (3) or the plane, a third conductor (7) connecting the second feeding point (6) and the second conductor (5), and a fourth conductor (8) connecting the second feeding point (6) and the second conductor (5) and disposed in a manner that is linearly symmetric, plane symmetric or electrically symmetric to the third conductor (7) with respect to the axis (3) or the plane.

Second Exemplary Embodiment

Figure 4:
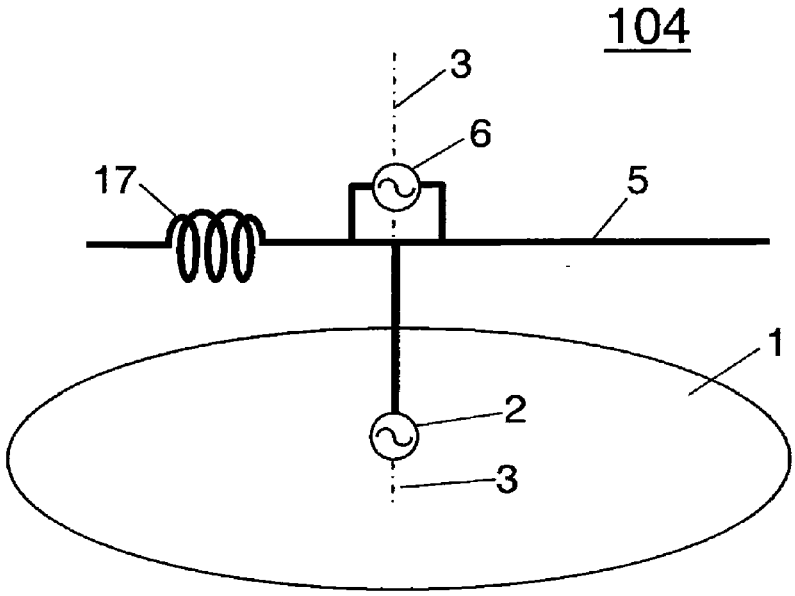
FIG. 4 is a perspective view showing a composite antenna according to a second exemplary embodiment of the present invention.

FIG. 4 is a perspective view showing composite antenna 104 according to the second exemplary embodiment of the present invention. The second exemplary embodiment differs from the first exemplary embodiment mainly in respect of that inductor 17 is connected midway along second conductor 5. Axis 3 is located generally in the center of ground plane 1. Second conductor 5 is not linearly symmetric about axis 3, but it is so formed that a length of the element at one side provided with inductor 17 is shorter than the other side not having inductor 17 so as to establish a linear symmetry in the electrical length with respect to axis 3. In short, inductor 17 and the element length of second conductor 5 are adjusted in a manner to maintain the linear symmetry in the electrical length with respect to axis 3.

Composite antenna 104 shown in FIG. 4 thus keeps the symmetry electrically although it does not well satisfy the structural symmetry. Distributions of the electric currents and voltages at both feeding points 2 and 6 become generally analogous to those of the first exemplary embodiment. This helps limit changes in voltage potentials at the individual feeding points 2 and 6, thereby ensuring the electrical isolation properly between these feeding points 2 and 6. As a result, this invention can reduce size of the composite antenna since it allows a narrower space from one antenna element to another, which had not been possible with the conventional structure in order to maintain the sufficient electrical isolation between the two antenna elements. Furthermore, this invention can simplify the antenna structure since it also allows two feeding points to share a single antenna element, whereas the conventional structure had required two sets of antenna element.

In FIG. 4, composite antenna 104 is illustrated as having generally the linear symmetric configuration with respect to axis 3. However, like operation, function and advantages are also attainable even if this structure of the antenna is so altered as to have a plane symmetric configuration with respect to any given plane orthogonal to ground plane 1.

Third Exemplary Embodiment

Figure 5:
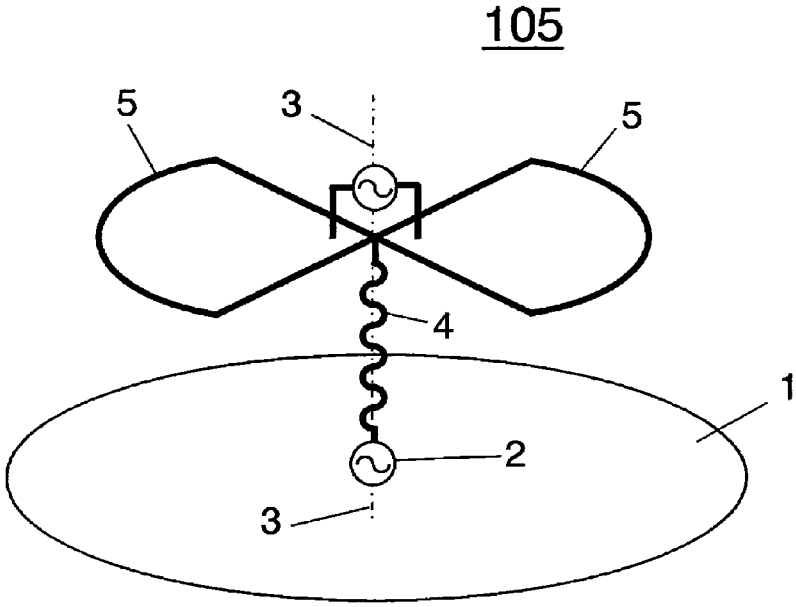
FIG. 5 is a perspective view showing a composite antenna according to a third exemplary embodiment of the present invention.

FIG. 5 is a perspective view showing composite antenna 105 according to the third exemplary embodiment of the present invention. The third exemplary embodiment differs from the first exemplary embodiment mainly in respects of that second conductor 5 has such a configuration as resembling two sectors linked at their centers, and that first conductor 4 has a meandering shape. Axis 3 is located generally in the center of ground plane 1. Since both first conductor 4 and second conductor 5 are generally linear symmetric in the shapes with respect to axis 3, composite antenna 105 exhibits an antenna operation similar to that discussed in the first exemplary embodiment. This antenna even provides a greater bandwidth characteristic since it has second conductor 5 of the configuration resembling two linked sectors. In addition, the meandering shape of first conductor 4 can lower a resonance frequency of composite antenna 105 when electric power is fed through first feeding point 2, which also helps reduce the size of composite antenna 105. Second conductor 5 may be designed into a round shape having linear symmetry about axis 3 so as to further broaden the bandwidth of the antenna. First conductor 4 may also be altered to any other shape beside the meandering shape as long as it is kept generally linear symmetric with respect to axis 3.

Fourth Exemplary Embodiment

Figure 6:
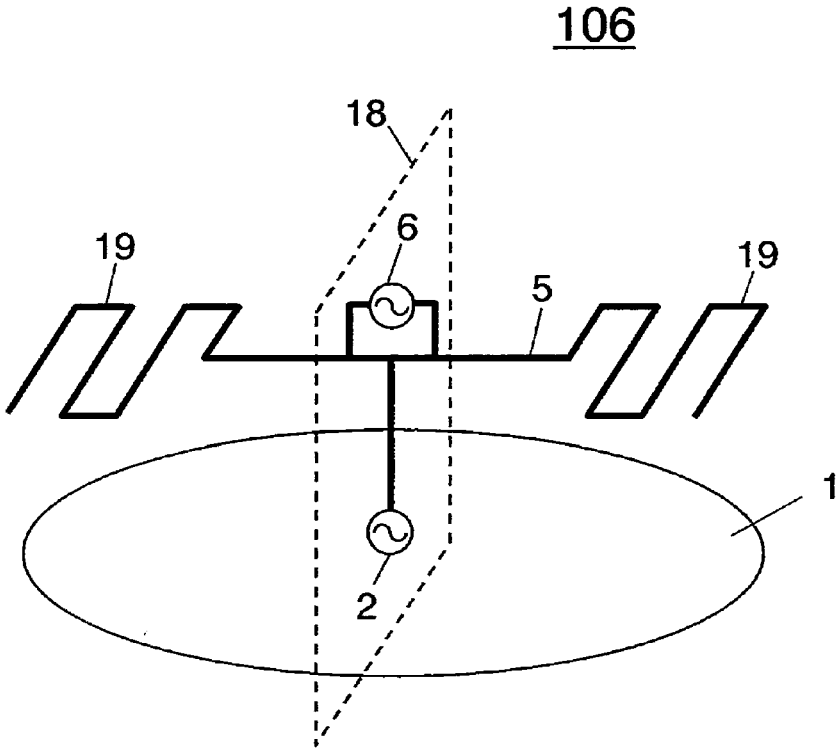
FIG. 6 is a perspective view showing a composite antenna according to a fourth exemplary embodiment of the present invention.

FIG. 6 is a perspective view showing composite antenna 106 according to the fourth exemplary embodiment of the present invention. The fourth exemplary embodiment differs from the first exemplary embodiment mainly in respects of that composite antenna 106 has a plane symmetric configuration with respect to plane 18, and that second conductor 5 is provided partly with meandering configuration 19.

Plane 18 is located generally in the center of ground plane 1. Composite antenna 106 having this structure of plane symmetry in the configuration with respect to plane 18 can also exhibit similar antenna operation as that of the first exemplary embodiment. This structure can thus ensure a sufficient electrical isolation between first feeding point 2 and second feeding point 6. In addition, meandering configuration 19 of second conductor 5 can lower a resonance frequencies of the individual antenna elements when electric power is fed through both of first feeding point 2 and second feeding point 6 respectively. As discussed, the configuration of second conductor 5 can be of any shape to lower the resonance frequency so long as it is plane symmetric with respect to plane 18. For example, second conductor 5 can be formed into a flat quadrangular shape, or even a loop configuration of oval or round shape. The above structure can lower the resonance frequencies while improving the wide band characteristic of the antenna at the same time.

Fifth Exemplary Embodiment

Figure 7:
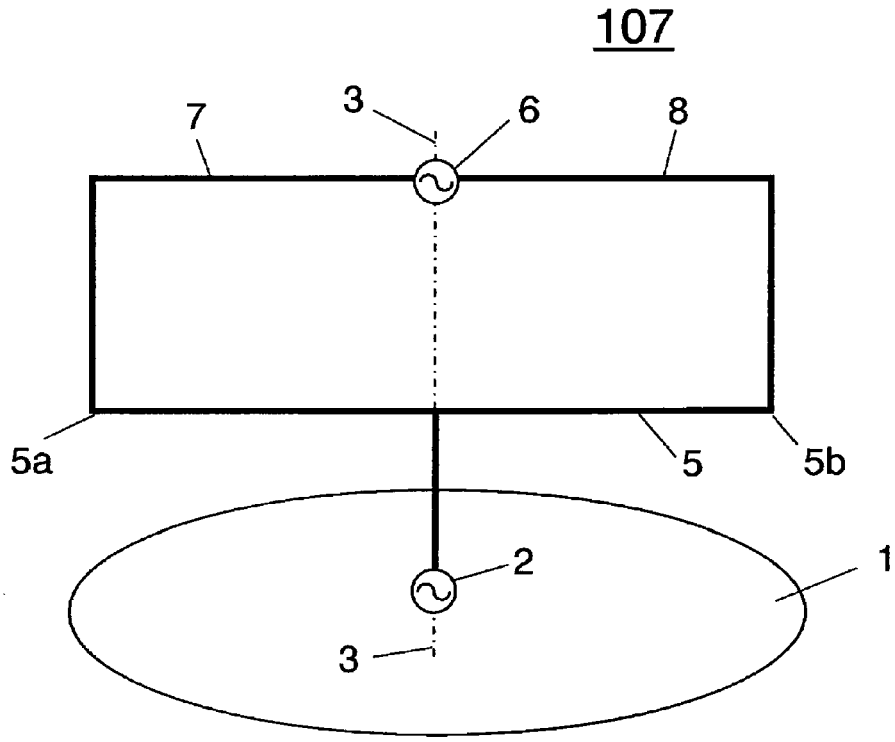
FIG. 7 is a perspective view showing a composite antenna according to a fifth exemplary embodiment of the present invention.

FIG. 7 is a perspective view of composite antenna 107 according to the fifth exemplary embodiment of the present invention. The fifth exemplary embodiment differs from the first exemplary embodiment mainly in respects of that third conductor 7 is connected to one end 5*a* of second conductor 5, and fourth conductor 8 is connected to the other end 5*b* of second conductor 5. This structure makes composite antenna 107 function as a loop antenna when an electric power is fed through second feeding point 6. Composite antenna 107 also functions as a monopole antenna when the power is fed through first feeding point 2. Accordingly, this exemplary embodiment can compose a complex antenna having functions of both the loop antenna, i.e., a magnetic current type antenna, and the monopole antenna, i.e., an electric current type antenna, with only a single antenna element. Composite antenna 107 of this structure is adaptable for use in a wide variety of environments, including areas in the proximity of a human body as well as in free space. This embodiment can also achieve a reduction in size of the composite antenna.

Moreover, composite antenna 107 may be so modified that a configuration formed by second conductor 5, third conductor 7 and fourth conductor 8 becomes an elongated rectangular shape by reducing the distance between second feeding point 6 and second conductor 5. This enables composite antenna 107 to function as a folded dipole antenna when an electric power is fed through second feeding point 6. Accordingly, this embodiment allows designing of the antenna with a high input impedance as measured from second feeding point 6 so as to achieve a wider bandwidth.

Sixth Exemplary Embodiment

Figure 8:
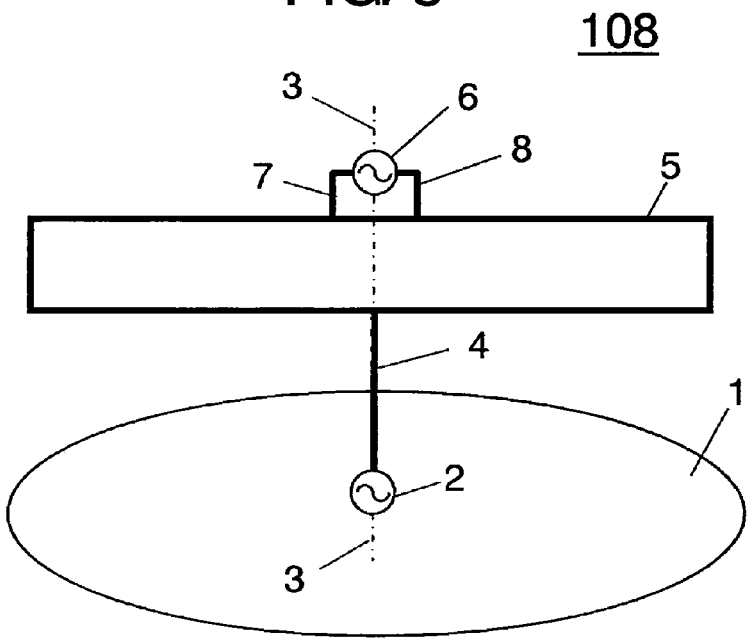
FIG. 8 is a perspective view showing a first composite antenna according to a sixth exemplary embodiment of the present invention.
Figure 9A:
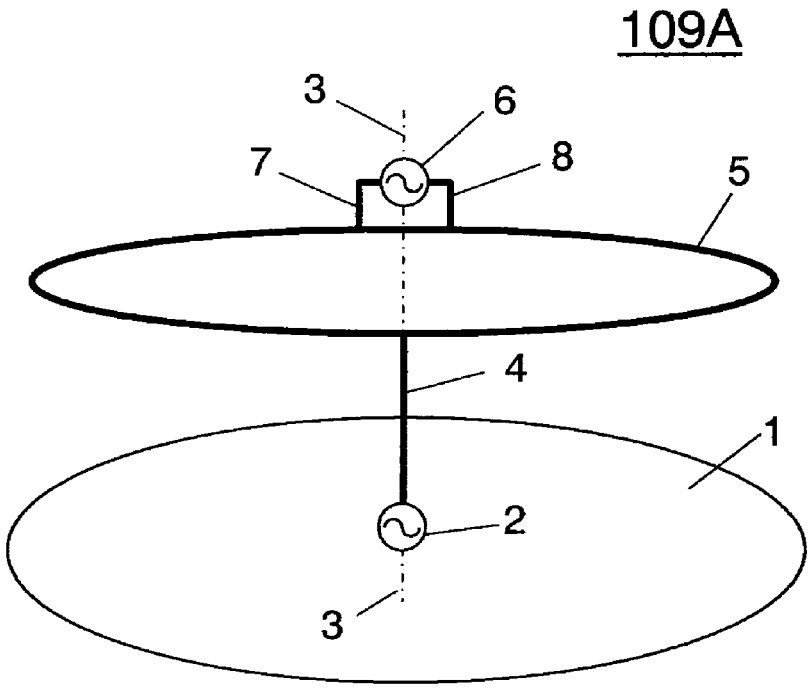
FIG. 9A is a perspective view showing a second composite antenna according to the sixth exemplary embodiment of the present invention.
Figure 9B:
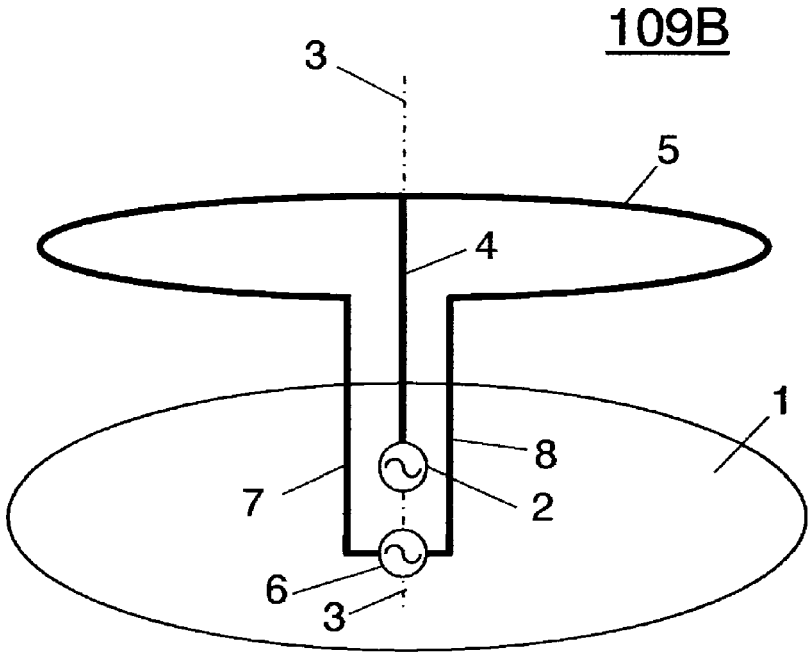
FIG. 9B is a perspective view showing another example of the second composite antenna according to the sixth exemplary embodiment of the present invention.

FIG. 8, FIG. 9A and FIG. 9B are perspective views of various composite antennas according to the sixth exemplary embodiment of the present invention. The sixth exemplary embodiment differs from the first exemplary embodiment mainly in respect of that second conductor 5 is formed into a quadrangular folded configuration as represented by composite antenna 108 shown in FIG. 8. This configuration can lower a resonance frequency of the antenna when an electric power is fed through first feeding point 2. It can also improve a radiating resistance of the antenna when the electric power is fed through second feeding point 6, so as to achieve the wide band characteristic.

Beside the shape shown in FIG. 8, the folded configuration of second conductor 5 can provide the like advantageous effect as composite antenna 108 of FIG. 8 even when it is altered to an oval shape as shown by composite antenna 109A of FIG. 9A.

In any of the composite antennas shown in FIG. 8 and FIG. 9A, third conductor 7 and fourth conductor 8 are connected to one side of second conductor 5 opposite the other side where first conductor 4 is connected. However, third conductor 7 and fourth conductor 8 can be connected to the same side of second conductor 5 where first conductor 4 is connected. Such configuration can still provide the advantageous effects similar to those of FIG. 8 and FIG. 9A. For instance, composite antenna 109A shown in FIG. 9A may be altered in shape like another composite antenna 109B, as illustrated in FIG. 9B, to achieve the like advantages as those of FIG. 8 and FIG. 9A.

Seventh Exemplary Embodiment

Figure 10:
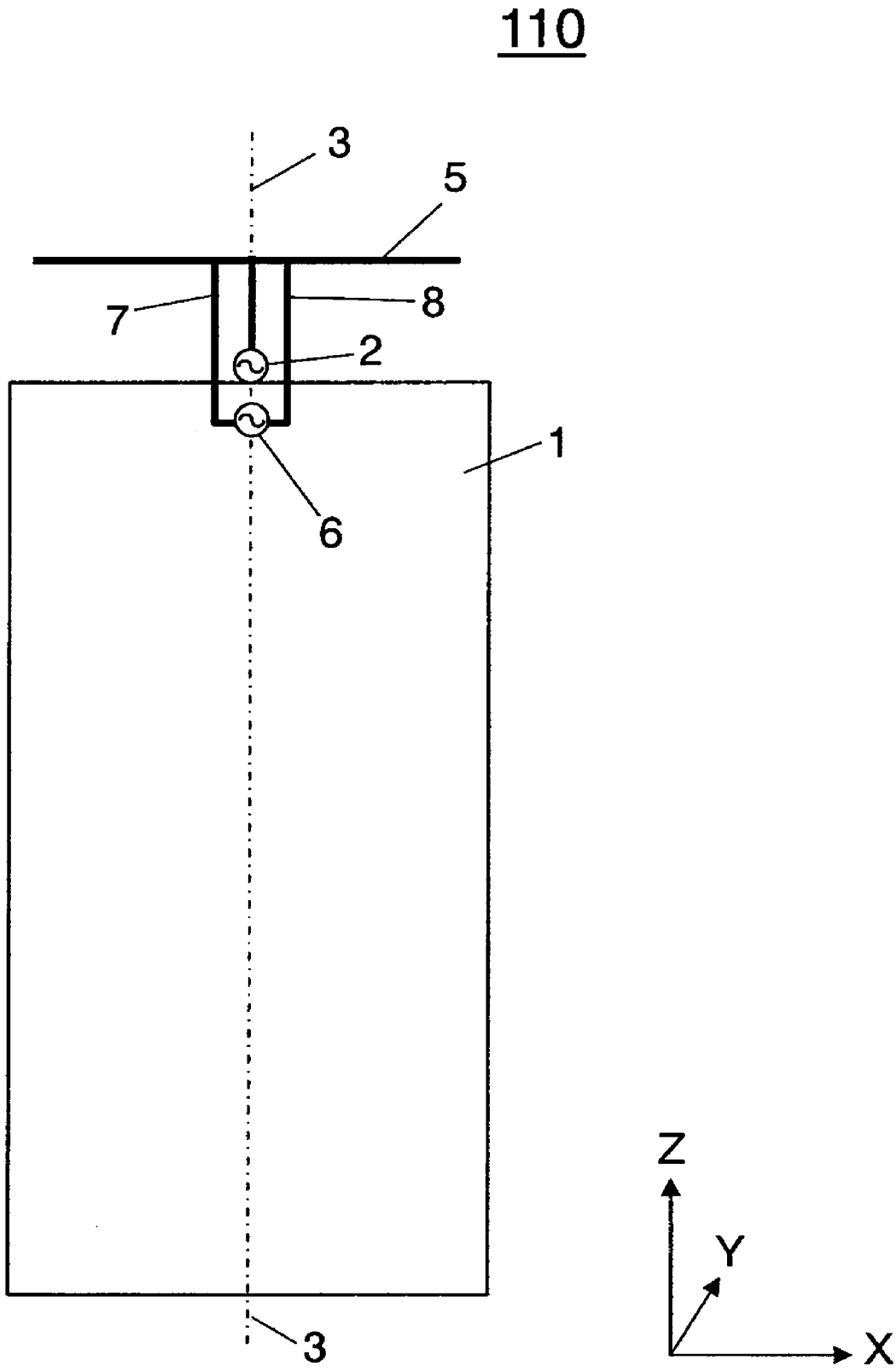
FIG. 10 is a top view showing a composite antenna according to a seventh exemplary embodiment of the present invention.

FIG. 10 is a top view of composite antenna 110 according to the seventh exemplary embodiment of the present invention. The seventh exemplary embodiment differs from the first exemplary embodiment mainly in respects of that ground plane 1 is formed into a quadrangular flat plane having a linearly symmetric shape with respect to axis 3, and first feeding point 2 is connected to one side of ground plane 1. Axis 3 is located generally in the center of ground plane 1. In the case of composite antenna 110 shown in FIG. 10, second feeding point 6 is not connected to ground plane 1. Neither third conductor 7 nor fourth conductor 8 is connected to ground plane 1.

Adoption of this structure increases a radiating resistance of the antenna when an electric power is fed to first feeding point 2 since a current contributing to the radiation flows in ground plane 1 (especially in the directions of ±Z-axis). This helps ease the impedance matching with other circuits and improves the radiation efficiency. The structure can also broaden the bandwidth of the antenna when the electric power is fed to the first feeding point, by changing a length of ground plane 1 in a manner to adjust its electrical length in the direction of Z-axis.

Ground plane 1 shown in FIG. 10 has the linearly symmetric shape with respect to axis 3. However, ground plane 1 needs not be linearly symmetric with respect to axis 3 to ensure the sufficient electrical isolation between first feeding point 2 and second feeding point 6 when the asymmetric shape is limited only to a portion of ground plane 1 where distribution of the current flow is low.

The composite antenna of the seventh exemplary embodiment is adaptable for a directional diversity antenna or a polarization diversity antenna of small size for use in a portable terminal and the like.

Eighth Exemplary Embodiment

Figure 11:
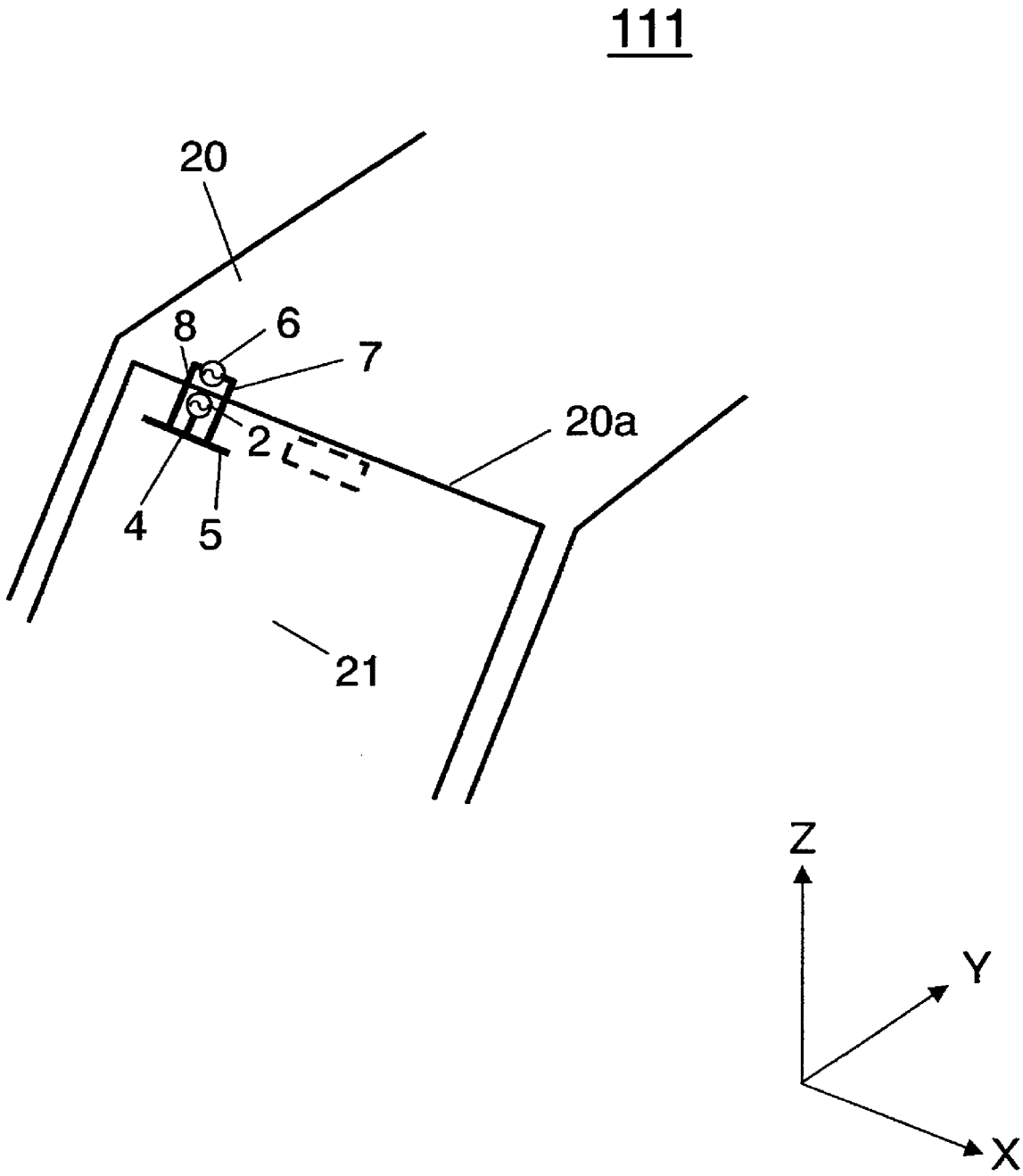
FIG. 11 is a perspective view showing a composite antenna according to an eighth exemplary embodiment of the present invention.

FIG. 11 is a perspective view of composite antenna 111 according to the eighth exemplary embodiment of the present invention. The eighth exemplary embodiment differs from the first exemplary embodiment mainly in the following aspects. That is, in the case of the first exemplary embodiment (FIG. 1 to FIG. 3), ground plane 1 is comprised of roof plate 20 of a motor vehicle, first feeding point 2 is connected to one side 20*a* of roof plate 20, and this composite antenna is disposed on windshield 21. In the eighth exemplary embodiment shown in FIG. 11, on the other hand, second feeding point 6 is not connected to roof plate 20. In addition, neither third conductor 7 nor fourth conductor 8 is connected to roof plate 20.

Adoption of this structure increases a radiating resistance of the antenna when an electric power is fed to first feeding point 2 since a current contributing to the radiation flows in roof plate 20 (especially in the directions of ±Y-axis). This helps ease the impedance matching with other circuits and improves the radiation efficiency. In this instance, a radiating pattern exhibits null points mainly in the directions of ±Y-axis, and the maximum gain along the directions of generally ±X-axis. In other words, the radiating pattern generally resembles the character "8" in the X-Y plane.

When the electric power is fed to second feeding point 6, on the other hand, the antenna shows a radiating pattern having the maximum gain along the direction of generally −Y-axis and the minimum gain along the direction of generally +Y-axis, since the current flowing in second conductor 5 mainly contributes to the radiation, and roof plate 20 serves as a reflector.

Accordingly, the composite antenna of the present invention is adaptable for use as a directional diversity antenna for motor vehicle since the radiating patterns exhibit the maximum gain in the different directions depending on where the signal is fed between feeding points 2 and 6. Because it is desirable that the diversity antenna attached to windshield 21 be small in size so as not to obstruct the view of the driver, this embodiment can provide the antenna structure suitable for such user needs.

In the case of a digital television performing such signal processing as synchronous detection and propagation path equalization during the signal demodulation, the antenna leads to degradation in quality of the reception when it receives scattered waves from an interior of the vehicle. Demands thus exist for antennas of such a radiating pattern that can avoid reception of the scattered waves from the vehicle interior, i.e., the pattern having a low antenna gain in the direction of the vehicle interior. There are also demands for antennas having a high performance of receiving incoming waves from directions (i.e., the directions of ±X-axis in FIG. 11) that are orthogonal to a traveling direction of the vehicle since the waves coming from these directions are not subjected to the Doppler frequency shift so as not to cause degradation in the reception quality during the signal demodulation. The radiation gain of the antenna in the direction of the vehicle interior can be thus reduced since roof plate 20 serves as the reflector when the electric power is fed through second feeding point 6.

The composite antenna can also be adapted to yield the maximum gain of the radiation pattern in the directions of ±X-axis when the electric power is fed through first feeding point 2.

Accordingly, the present invention achieves the composite antenna of small size, which is suitable for use as a diversity antenna attached to windshield 21 of a motor vehicle for a digital television and digital radio, as shown in FIG. 11, thereby making a substantial improvement of the receiving characteristic.

Composite antenna 111 of this invention may be formed into a configuration of film-type antenna. The antenna so formed does not adversely affect or obstruct the view of the driver. This composite antenna also provides the like advantages even when mounted to a rear windshield.

Ninth Exemplary Embodiment

Figure 12:
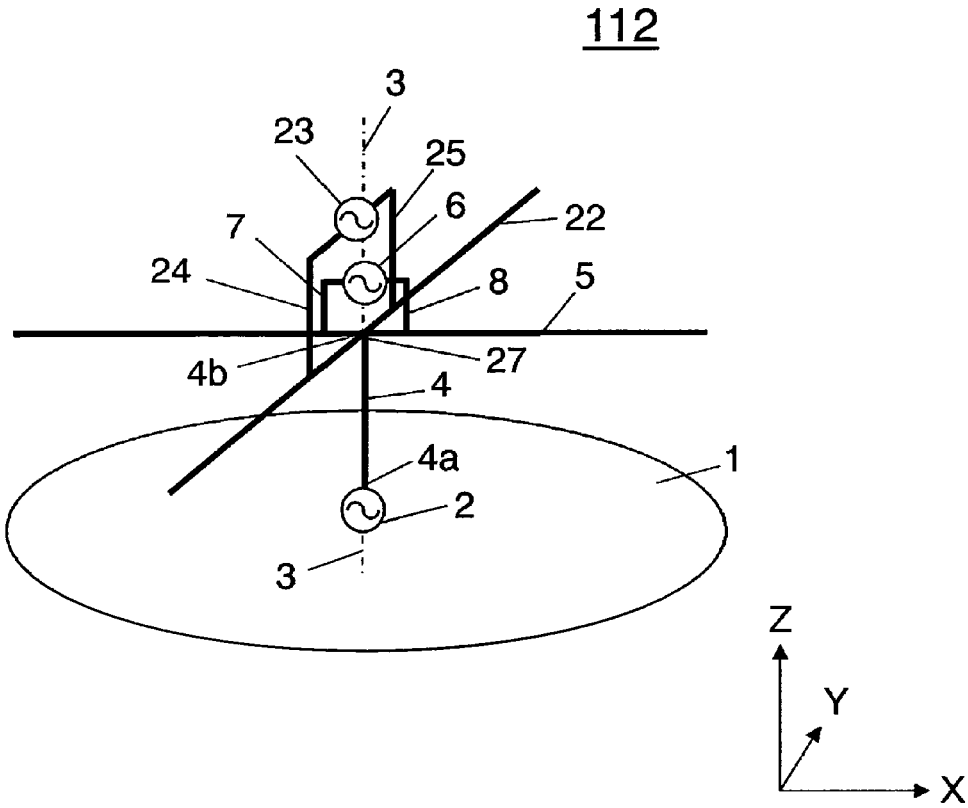
FIG. 12 is a perspective view showings a composite antenna according to a ninth exemplary embodiment of the present invention.

FIG. 12 is a perspective view of composite antenna 112 according to the ninth exemplary embodiment of the present invention. Composite antenna 112 comprises ground plane 1 having generally a planar shape, first feeding point 2 connected to ground plane 1, and first conductor 4 having one end 4*a* connected to first feeding point 2, first conductor 4 having a linearly symmetric configuration with respect to axis 3 which is orthogonal to ground plane 1. Axis 3 is located generally in the center of ground plane 1. Composite antenna 112 also comprises second conductor 5 having a linearly symmetric configuration with respect to axis 3, and generally a center portion of second conductor 5 is connected to other end 4*b* of first conductor 4. Composite antenna 112 further comprises second feeding point 6 set on axis 3, third conductor 7 connecting second feeding point 6 and second conductor 5, and fourth conductor 8 also connecting second feeding point 6 and second conductor 5 and disposed in a linearly symmetrical manner to third conductor 7 with respect to axis 3.

In addition, composite antenna 112 comprises fifth conductor 22 disposed in an orientation orthogonal to second conductor 5 and having an electrically and linearly symmetric configuration with respect to axis 3, third feeding point 23 set on axis 3, sixth conductor 24 connecting third feeding point 23 and fifth conductor 22, and seventh conductor 25 also connecting third feeding point 23 and fifth conductor 22 and disposed in an electrically and linearly symmetrical manner to sixth conductor 24 with respect to axis 3.

Composite antenna 112 shown in FIG. 12 functions as an unbalanced type antenna when an electric power is fed through first feeding point 2. On the other hand, composite antenna 112 of FIG. 12 functions as a balanced type antenna when an electric power is fed through any of second feeding point 6 and third feeding point 23.

Figure 13:
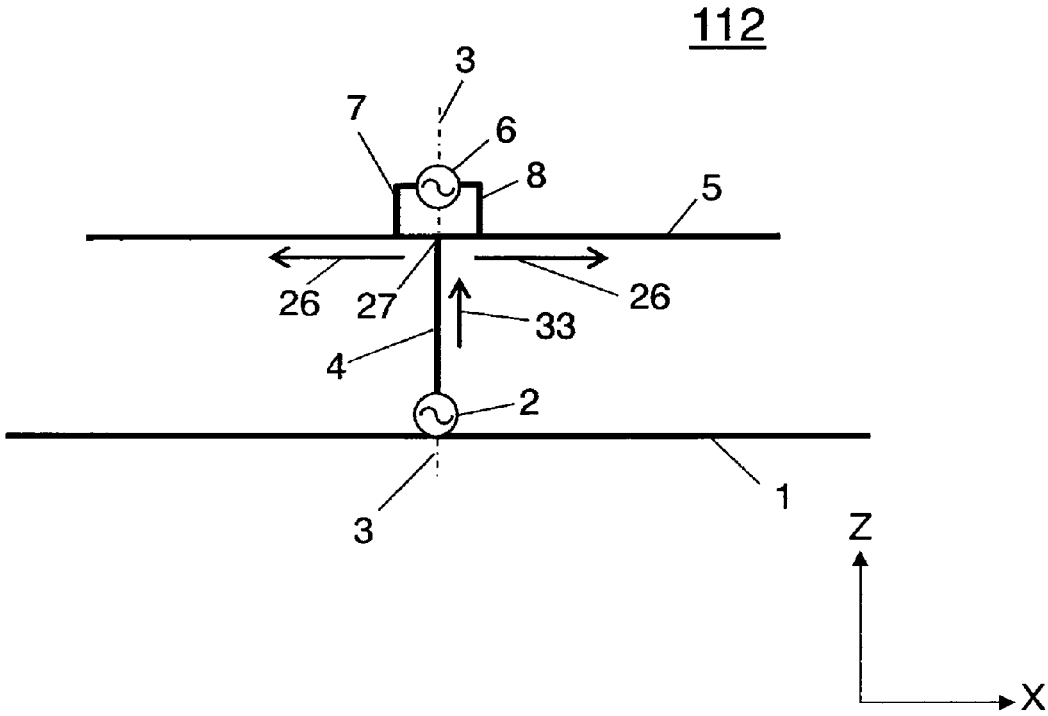
FIG. 13 is a sectional view of the same composite antenna showing a state when an electric power is fed to a first feeding point.
Figure 14:
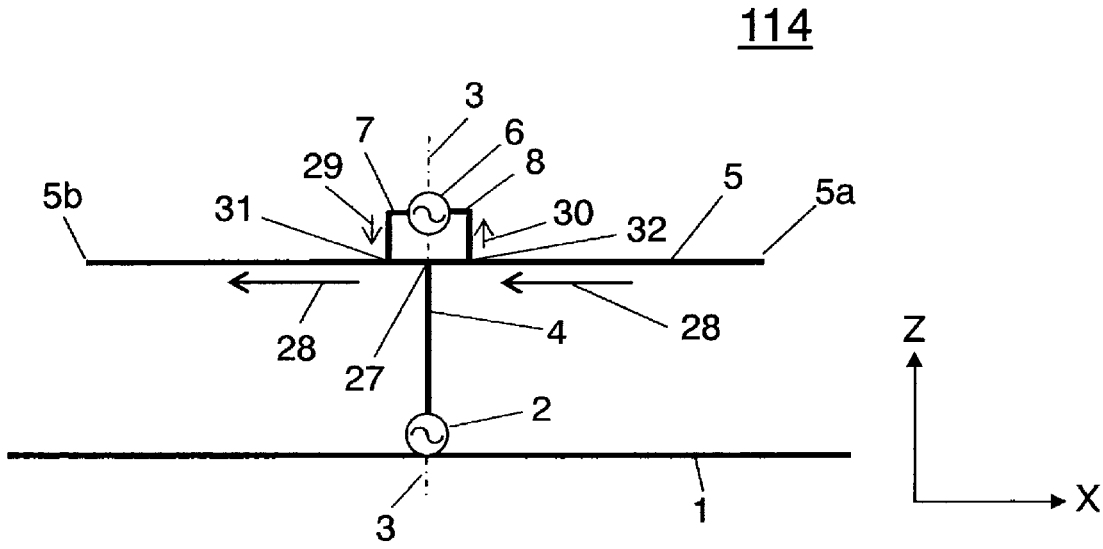
FIG. 14 is a sectional view of the same composite antenna showing a state when an electric power is fed to a second feeding point.

Referring now to FIG. 13 and FIG. 14, description is provided of an operating principle of composite antenna 112 of the ninth exemplary embodiment shown in FIG. 12. The description specifically puts a focus on the reason why sufficient electrical isolations can be ensured amongst first feeding point 2, second feeding point 6 and third feeding point 23.

FIG. 13 shows a sectional view of composite antenna 112 shown in FIG. 12 as it is sectioned along the X-Z plane where second conductor 5 lies. Referring to FIG. 13, when an electric power is fed through first feeding point 2 to make composite antenna 112 of FIG. 12 function as an unbalanced type antenna, electric currents 26 delivered from first feeding point 2 via first conductor 4 flow through second conductor 5 in the outward directions from junction 27 between first conductor 4 and second conductor 5, as shown in FIG. 13. For the purpose of simplifying the explanation, FIG. 13 illustrates electric currents 26 as being in the outward directions from junction 27. However, the directions of electric currents 26 change alternately between the outward directions and the inward directions with respect to junction 27 at cyclic durations corresponding to a frequency of the signal supplied to first feeding point 2.

An electromagnetic field coupling of first conductor 4 with second conductor 5 becomes generally linear symmetric about axis 3 since both second conductor 5 and first conductor 4 are linearly symmetric with respect to axis 3. For this reason, electric currents 26 flow along second conductor 5 in the symmetrical manner about axis 3. Voltage potentials produced by electric currents 26 flowing outwardly from junction 27 appear at a junction between second feeding point 6 and third conductor 7 as well as another junction between second feeding point 6 and fourth conductor 8, but a difference in the potential between these junctions always remains at nearly zero volt because third conductor 7 and fourth conductor 8 are linearly symmetrical with respect to axis 3. Composite antenna 112 constructed as shown in FIG. 12 eliminates interference from first feeding point 2 to second feeding point 6 when it is used as an unbalanced type antenna by feeding electric power to first feeding point 2, thereby ensuring the sufficient electrical isolation between these feeding points.

What has been described with reference to FIG. 13 is the reason why the electrical isolation can be ensured between second feeding point 6 and first feeding point 2 on the basis of current distribution in second conductor 5. The same reason also applies to the isolation between third feeding point 23 and first feeding point 2 in FIG. 12. Sufficient electrical isolation can hence be ensured between third feeding point 23 and first feeding point 2.

Referring to FIG. 14, description is provided next of an operating principle of composite antenna 112 of FIG. 12 when it is functioned as a balanced type antenna by feeding an electric power through second feeding point 6. FIG. 14 shows a sectional view of composite antenna of FIG. 12 as it is sectioned along the X-Z plane where second conductor 5 lies. Electric current 28 induced in second conductor 5 flows in one direction from one end 5*a* to the other end 5*b* of second conductor 5. Here, an electromagnetic field coupling of second conductor 5 with first conductor 4 becomes generally linear symmetric about axis 3 since both second conductor 5 and first conductor 4 are linearly symmetrical in their configurations with respect to axis 3.

In addition, voltage distribution along second conductor 5 is such that it always becomes nearly zero volt at junction 27 between first conductor 4 and second conductor 5 since second conductor 5 is formed into generally a linearly symmetric configuration with respect to axis 3. Accordingly, composite antenna 112 shown in FIG. 12 can eliminate undesired interference to first feeding point 2 from second feeding point 6 when it is used as a balanced type antenna by feeding the signal to second feeding point 6, thereby ensuring the sufficient electrical isolation between these feeding points.

Although what has been described with reference to FIG. 14 is the reason why the electrical isolation is ensured between second feeding point 6 and first feeding point 2 on the basis of current distribution in second conductor 5, the same reason also applies to the isolation between third feeding point 23 and first feeding point 2 in FIG. 12, and sufficient electrical isolation can hence be ensured between third feeding point 23 and first feeding point 2.

In composite antenna 112 shown in FIG. 12, when electric powers are equally fed through both second feeding point 6 and third feeding point 23 in a well-balanced manner, a voltage potential becomes nearly zero volt at junction 27 where second conductor 5 and fifth conductor 22 are connected directly. This can therefore obviate a drawback, in which the signal fed from second feeding point 6 leaks to fifth conductor 22. It also avoids a problem of electromagnetic coupling between second conductor 5 and fifth conductor 22, since second conductor 5 and fifth conductor 22 are disposed at right angles. This is because the polarizing orientations of second conductor 5 and fifth conductor 22 are orthogonal with respect to each other. Sufficient electrical isolation can therefore be ensured between second feeding point 6 and third feeding point 23.

As described above, the present invention makes it unnecessary to provide relatively large spatial distance between three antenna elements that had been needed in the conventional structure to ensure the electrical isolation between the antenna elements, thereby achieving a reduction in size of the composite antenna. In addition, this invention allows three feeding points to share the two antenna elements instead of the three antenna elements needed in the conventional structure, so as to simplify the antenna structure.

Furthermore, an impedance matching of this composite antenna at second feeding point 6 can be made by adjusting a distance from junction 31 between second conductor 5 and third conductor 7 to junctions 27 as well as a distance from junction 32 between second conductor 5 and fourth conductor 8 to junctions 27, in FIG. 14. This makes the impedance matching easier than the conventional dipole antenna positioned adjacent to ground plane 1. Generally similar method also applies when making an impedance matching at third feeding point 23 of this composite antenna.

Description is provided next of a radiating pattern of composite antenna 112 of this invention with reference to FIG. 13 and FIG. 14. When a signal is supplied through first feeding point 2, electric current 33 induced in first conductor 4 is the current that contributes to the radiation. Electric currents 26 induced in second conductor 5 do not greatly influence the radiating pattern because the directions of flow are opposite to each other with respect to junction 27. As a result, the radiating pattern of composite antenna 112 shown in FIG. 12 generally exhibits a non-directional characteristic in the X-Y plane (i.e., polarization in Z-axis), and null points in the directions of ±Z-axis, when the signal is supplied to second feeding point 6.

When the signal is supplied through second feeding point 6, on the other hand, electric current 28 induced in second conductor 5 is the current that contributes to the radiation, but no current is induced in first conductor 4 to contribute to the radiation. Furthermore, electric current 29 flowing in third conductor 7 and electric current 30 flowing in fourth conductor 8 are in the directions opposite to each other. Therefore, they do not significantly affect to the radiating pattern when a space between third conductor 7 and fourth conductor 8 is set small relative to the wavelength. When the signal is supplied through second feeding point 6, the radiating pattern of composite antenna 112 shown in FIG. 12 exhibits null points in the directions of generally ±X-axis and a non-directional characteristic in the Y-Z plane (i.e., polarization in X-axis) on the assumption that ground plane 1 does not exist. If ground plane 1 does not exist, however, the radiating pattern would then exhibit the highest gain in the direction of +Z-axis due to reflection by ground plane 1.

When a signal is supplied through third feeding point 23 in FIG. 12, distribution of a current induced in fifth conductor 22 becomes similar to that when the signal is supplied through second feeding point 6. A radiating pattern in this case exhibits null points in the directions of generally +Y-axis and a non-directional characteristic in the X-Z plane (i.e., polarization in Y-axis) on the assumption that ground plane 1 does not exist. In reality however, the radiating pattern exhibits the highest gain in the direction of +Z-axis since ground plane 1 reflects the radiation.

In the manner as described, the radiating patterns formed by the signals supplied through the corresponding feeding points compensate the null points with each other, and polarizing orientations of the individual antenna are different in the directions of ±X-axis and ±Y-axis, composite antenna 112 shown in FIG. 12 can hence be used as a directional diversity antenna and a polarization diversity antenna.

In the case of supplying signals of the same frequency to both first feeding point 2 and second feeding point 6 in FIG. 12, it is possible for the composite antenna to radiate circularly polarized waves in the directions of generally ±Y-axis by properly adjusting phases of the individual signals. The directions to which the circularly polarized waves are radiated change depending on the shape of ground plane 1. It is also possible for the composite antenna to radiate the circularly polarized waves in the directions of generally ±X-axis by properly adjusting phases of the individual signals of the same frequency supplied to first feeding point 2 and third feeding point 23. The directions to which the circularly polarized waves are radiated also change depending on the shape of ground plane 1. Moreover, it is also possible for the composite antenna to radiate the circularly polarized waves in the directions of generally ±Z-axis by properly adjusting phases of the individual signals of the same frequency supplied to second feeding point 6 and third feeding point 23. The directions to which the circularly polarized waves are radiated still change depending on the shape of ground plane 1.

Composite antenna 112 shown in FIG. 12 can function in the above manner as a circular polarization antenna capable of radiating the circularly polarized waves in many directions despite of its small and simple structure.

Composite antenna 112 of the present invention shown in FIG. 12 can be used not only as a diversity antenna but also used as a triplex antenna for three systems. As a result, the invention can help reduce a number of antennas necessary for cellular phones provided with a variety of different systems, thereby achieving a reduction in size of the cellular phones.

Moreover, composite antenna 112 shown in FIG. 12 can also be used as a multiplexer or a part thereof. Since this makes a separate multiplexer unnecessary, it can achieve a further reduction in size of telecommunications devices such as cellular phones.

Use of composite antenna 112 shown in FIG. 12 as a part of multiplexer can help design the multiplexer while also achieving a low passing loss of the signals. This can improve an NF characteristic of a portable terminal when used as a receiver, and reduce power consumption of a power amplifier when used as a transmitter.

The signals supplied to first feeding point 2, second feeding point 6, and third feeding point 23 may be of the same frequency or different frequencies. Composite antenna 112 shown in FIG. 12, when adapted for handling signals of different frequencies supplied to first feeding point 2, second feeding point 6 and third feeding point 23, can be used as an antenna of a telecommunications device employing complex systems of various kinds that uses a number of frequencies.

Referring to FIG. 12, the substance of the ninth exemplary embodiment can be summarized as follows. That is, the composite antenna according to the present invention comprises a ground plane (1), a first feeding point (2) connected to the ground plane (1), a first conductor (4) connected to the first feeding point (2) and having a linearly symmetric or plane symmetric configuration or electrically symmetric characteristic with respect to an axis (3) or a plane orthogonal to the ground plane (1), a second feeding point (6), a second conductor (5) having a linearly symmetric or plane symmetric configuration with respect to the given axis (3) in alignment with the second feeding point (6) and connected to the first conductor (4), a third conductor (7) connecting the second feeding point (6) and the second conductor (5), a fourth conductor (8) connecting the second feeding point (6) and the second conductor (5) and disposed generally in a linearly symmetrical manner to the third conductor (7) with respect to the given axis (3), a third feeding point (23) set on the given axis (3), a fifth conductor (22) disposed in an orientation generally orthogonal to the second conductor (5) and having generally a linear symmetric or plane symmetric configuration with respect to the given axis (3), a sixth conductor (24) connecting the third feeding point (23) and the fifth conductor (22), and a seventh conductor (25) also connecting the third feeding point (23) and the fifth conductor (22) and disposed generally in a linearly symmetrical or plane symmetrical manner to the sixth conductor (24) with respect to the given axis (3).

Tenth Exemplary Embodiment

Figure 15:
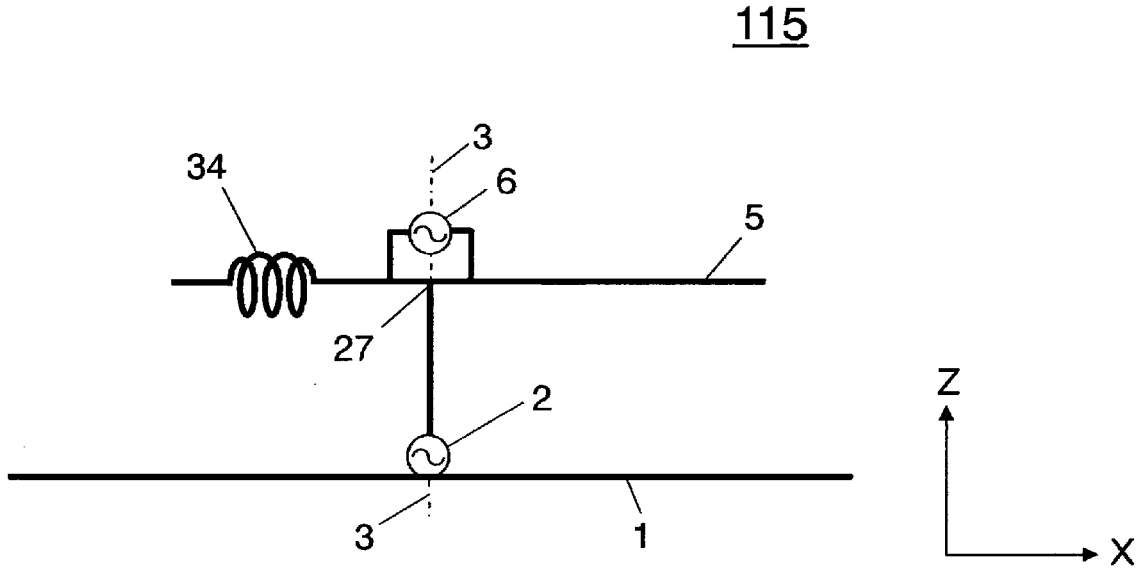
FIG. 15 is a sectional view showing a composite antenna according to a tenth exemplary embodiment of the present invention.

FIG. 15 is a sectional view of composite antenna 115 according to the tenth exemplary embodiment. In particular, this figure shows a structure as it is sectioned along an X-Z plane where second conductor 5 lies. This tenth exemplary embodiment is generally analogous to the ninth exemplary embodiment.

The tenth exemplary embodiment differs from the ninth exemplary embodiment mainly in respect of that inductor 34 is connected midway along second conductor 5. Second conductor 5 is not linearly symmetric with respect to axis 3, but it is so formed that a length of the element at one side provided with inductor 34 is shorter than the other side not having inductor 34. Therefore, inductor 34 and the element length of second conductor 5 are adjusted in such a manner that electrical length of second conductor 5 becomes linearly symmetric with respect to axis 3. In other words, the structure shown in FIG. 15 keeps the symmetry electrically although it does not well satisfy the structural symmetry. As a result, distributions of the electric currents and voltages at both feeding points 2 and 6 become generally analogous to those of the ninth exemplary embodiment. This helps limit changes in voltage potentials at the individual feeding points 2 and 6, thereby ensuring the electrical isolation properly between these feeding points 2 and 6.

When fifth conductor 22 shown in FIG. 12 is employed in addition to the structure shown in FIG. 15, an electrical isolation can be ensured between third feeding point 23 and first feeding point 2 so long as fifth conductor 22 maintains the symmetry in electrical characteristic with respect to axis 3 in the same manner as second conductor 5 in FIG. 15, even if it is not structurally symmetric.

In addition, a voltage potential at junction 27 is kept to nearly zero volt since second conductor 5 shown in FIG. 15 is formed electrically symmetric with respect to axis 3, thereby ensuring the electrical isolation between second feeding point 6 and third feeding point 23. As a result, this invention makes it unnecessary to provide the relatively large spatial distance between the two antenna elements that had been needed to ensure the electrical isolation between these elements in the conventional structure. The invention can thus reduce the size of composite antenna 115. Furthermore, this invention can simplify the antenna structure since it also allows three feeding points to share the two antenna elements instead of three antenna elements needed in the conventional structure.

In FIG. 15, the composite antenna is illustrated as having the linearly symmetric configuration with respect to axis 3. However, like function is also attainable even if this composite antenna is altered to have a plane symmetric configuration with respect to any given plane within ground plane 1.

Eleventh Exemplary Embodiment

Figure 16:
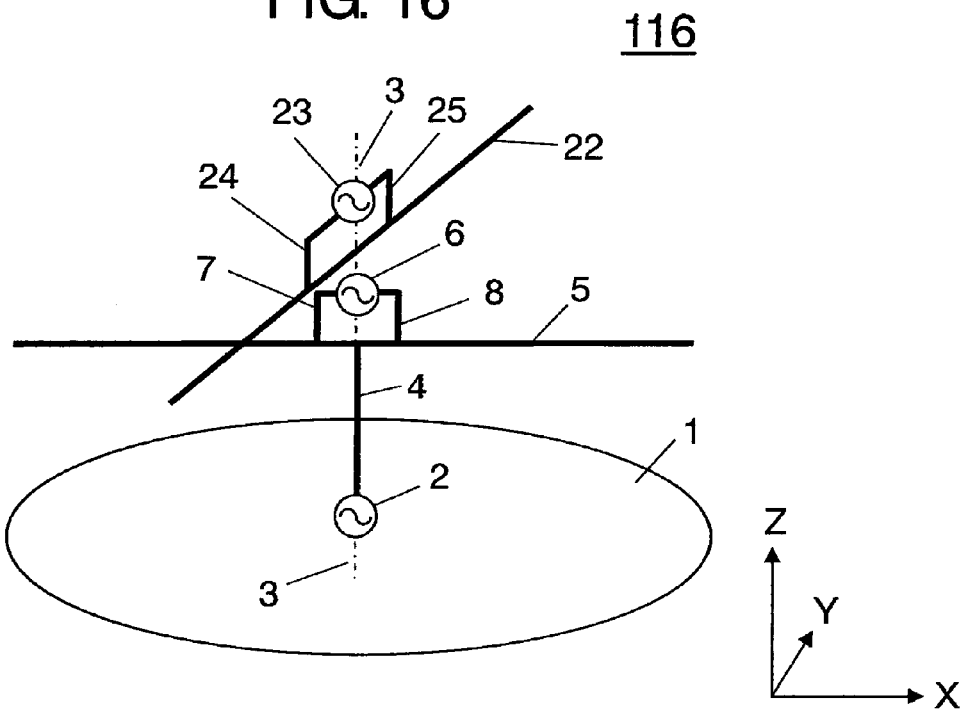
FIG. 16 is a perspective view showing a composite antenna according to an eleventh exemplary embodiment of the present invention.

FIG. 16 is a perspective view of composite antenna 116 according to the eleventh exemplary embodiment. Advantageous features of the invention in the eleventh exemplary embodiment are generally analogous to those of the ninth exemplary embodiment. The eleventh exemplary embodiment differs from the ninth exemplary embodiment mainly in respect of that second conductor 5 and fifth conductor 22 are not connected directly as shown in FIG. 16. Even the antenna having such a structure, as in this eleventh exemplary embodiment, can still function in the same manner and provide the like advantageous effects as those of the ninth exemplary embodiment. Accordingly, this embodiment can eliminate a step of connecting second conductor 5 and third conductor 9, so as to simplify the process of manufacturing the composite antenna.

In the structure shown in FIG. 16, fourth conductor 9, sixth conductor 24 and seventh conductor 25 may be substituted by a simple dipole antenna.

Twelfth Exemplary Embodiment

Figure 17:
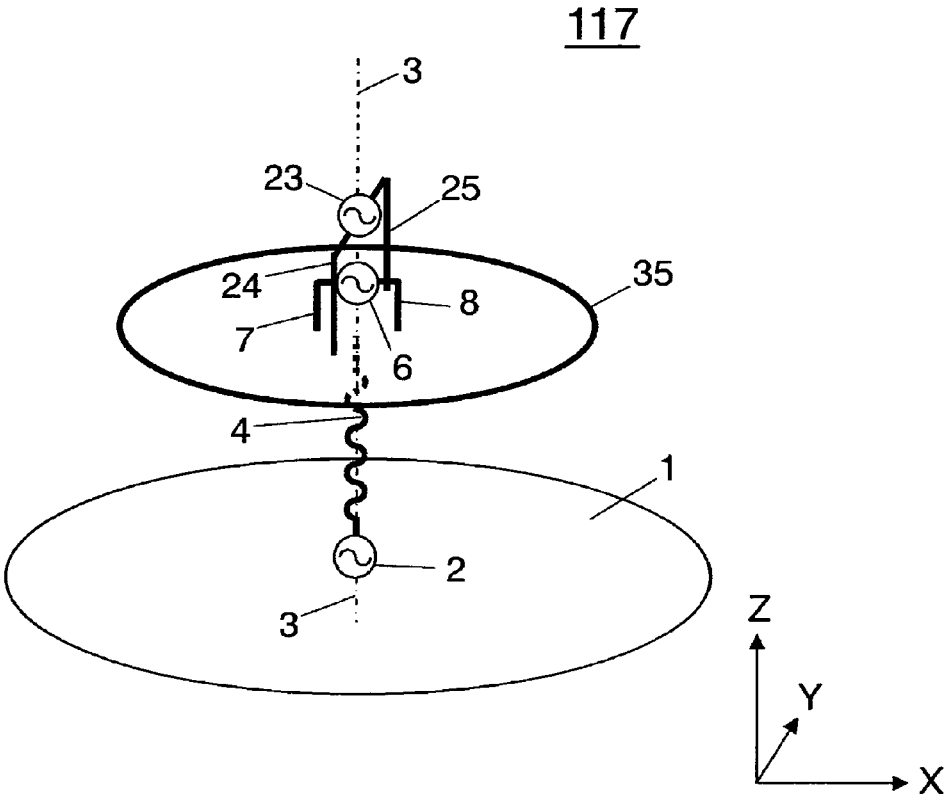
FIG. 17 is a perspective view showing a composite antenna according to a twelfth exemplary embodiment of the present invention.

FIG. 17 is a perspective view showing composite antenna 117 according to the twelfth exemplary embodiment. The twelfth exemplary embodiment differs from the ninth exemplary embodiment mainly in respects of that second conductor 5 and fifth conductor 22 are replaced with round conductor 35 formed of a single conductor, and that first conductor 4 has a meandering shape, as shown in FIG. 17. The composite antenna can function generally in the same manner as the ninth exemplary embodiment even though second conductor 5 and fifth conductor 22 are replaced with single round conductor 35. Here, second conductor 5 and fifth conductor 22 can be replaced with a regular polygonal conductor having "n" sides (where "n"=m×2+2, with m being an integer not smaller than 1), instead of the round conductor.

Since first conductor 4 is generally linearly symmetric with respect to axis 3, this composite antenna can function in the same manner, and therefore provide the like advantageous effect as those of the ninth exemplary embodiment. Moreover, because the functions of second conductor 5 and fifth conductor 22 are materialized with the single element of round conductor 35, this embodiment can improve robustness of the antenna structure while also simplifies the process of manufacturing composite antenna 117.

Thirteenth Exemplary Embodiment

Figure 18:
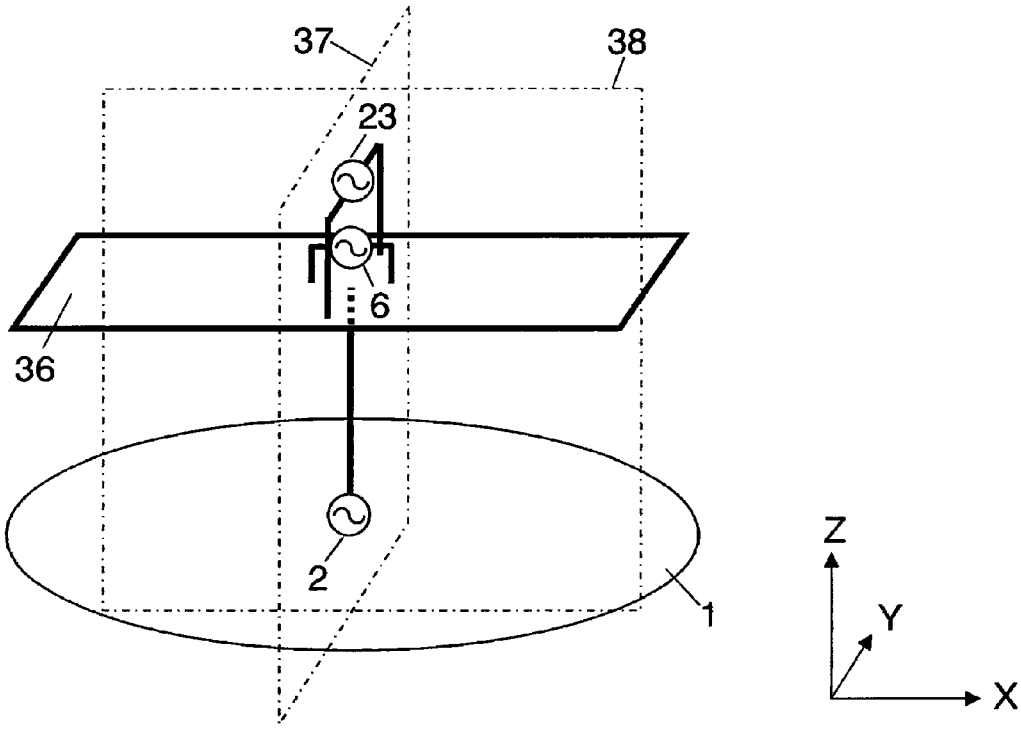
FIG. 18 is a perspective view showing a composite antenna according to a thirteenth exemplary embodiment of the present invention.

FIG. 18 is a perspective view of composite antenna 118 according to the thirteenth exemplary embodiment. Advantageous features of the thirteenth exemplary embodiment are generally analogous to those of the ninth exemplary embodiment.

The thirteenth exemplary embodiment differs from the ninth exemplary embodiment mainly in respect of that second conductor 5 and fifth conductor 22 are replaced with a single unit of rectangular conductor 36 as shown in FIG. 18. Rectangular conductor 36 has such a shape that is either plane symmetric or electrically symmetric with respect to both of Y-Z plane 37 and X-Z plane 38. For this reason, composite antenna 118 can function in the same manner, and provide the like advantageous effect as those of the ninth exemplary embodiment.

Since the functions of second conductor 5 and fifth conductor 22 are materialized with the single unit of rectangular conductor 36, this embodiment can improve robustness of the antenna structure while also simplify the process of manufacturing the composite antenna. Moreover, by virtue of the rectangular shape of conductor 36, this composite antenna can operate in two frequencies and broaden the bandwidth when an electric power is fed through first feeding point 2. In other words, this composite antenna can yield a different resonance frequency when the electric power is fed through second feeding point 6 as opposed to another resonance frequency when the electric power is fed through third feeding point 23.

Fourteenth Exemplary Embodiment

Figure 19:
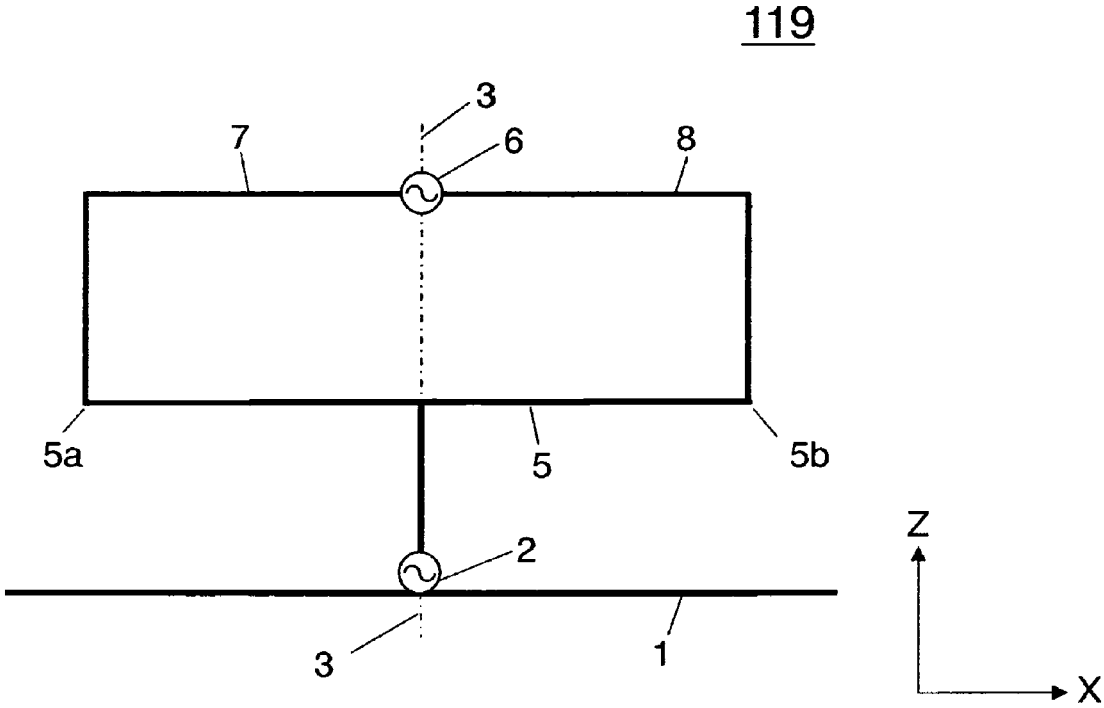
FIG. 19 is a sectional view showing a composite antenna according to a fourteenth exemplary embodiment of the present invention.

FIG. 19 is a sectional view of composite antenna 119 according to the fourteenth exemplary embodiment. This figure shows, in particular, a structure as it is sectioned along an X-Z plane where second conductor 5 lies. This fourteenth exemplary embodiment is generally analogous to the ninth exemplary embodiment.

The fourteenth exemplary embodiment differs from the ninth exemplary embodiment mainly in respects of that third conductor 7 is connected to one end 5*a* of second conductor 5, and fourth conductor 8 is connected to the other end 5*b* of second conductor 5, as shown in FIG. 19.

This structure makes the composite antenna functions as a loop antenna when an electric power is fed through second feeding point 6, and as a monopole antenna when the electric power is fed through first feeding point 2. Accordingly, this exemplary embodiment can compose a complex antenna having functions of both the loop antenna, i.e., a magnetic current type antenna, and the monopole antenna, i.e., an electric current type antenna, only with a single antenna element. This embodiment can thus make the composite antenna adaptable for use in a wide variety of environments, including areas in the proximity of a human body as well as in free space, and also achieve a reduction in size of the antenna.

In addition, the composite antenna may be so modified that a configuration formed by second conductor 5, third conductor 7 and fourth conductor 8 becomes an elongated rectangular shape (i.e., elongated square) by reducing the distance between second feeding point 6 and second conductor 5, so that it can be functioned as a folded dipole antenna when an electric power is fed through second feeding point 6. This allows designing of the antenna with a high input impedance as measured from second feeding point 6 so as to achieve a wider bandwidth. The composite antenna of the fourteenth exemplary embodiment may be provided additionally with fifth conductor 22, sixth conductor 24 and seventh conductor 25 shown in FIG. 12, for instance, although not shown in FIG. 19. The composite antenna having such a structure can also provide generally the same advantageous effects. In this instance, any of second conductor 5 and fifth conductor 22 may be altered into a loop configuration of a square, oval and round in shape.

Fifteenth Exemplary Embodiment

Figure 20:
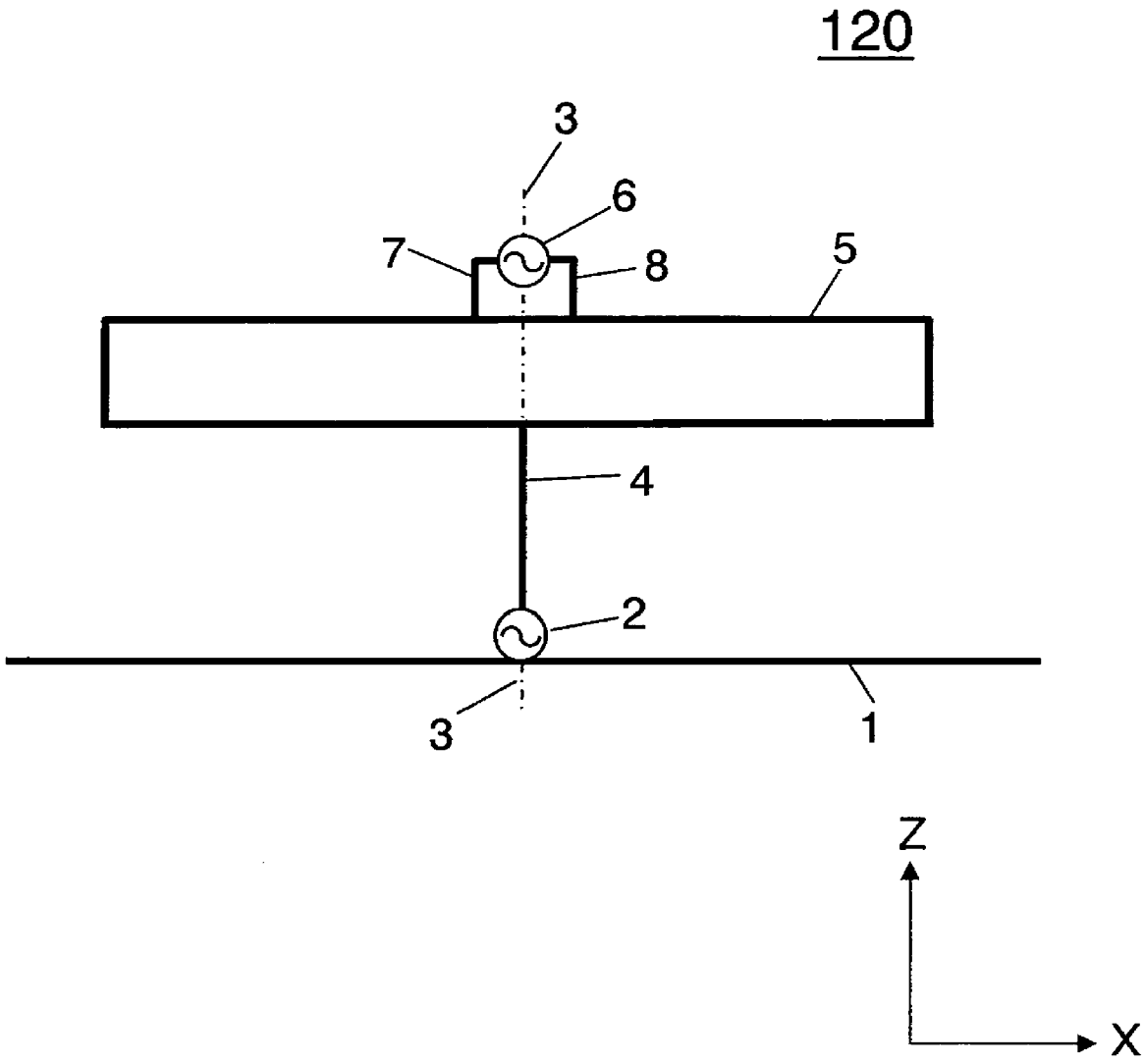
FIG. 20 is a sectional view showing a first composite antenna according to a fifteenth exemplary embodiment of the present invention.
Figure 21A:
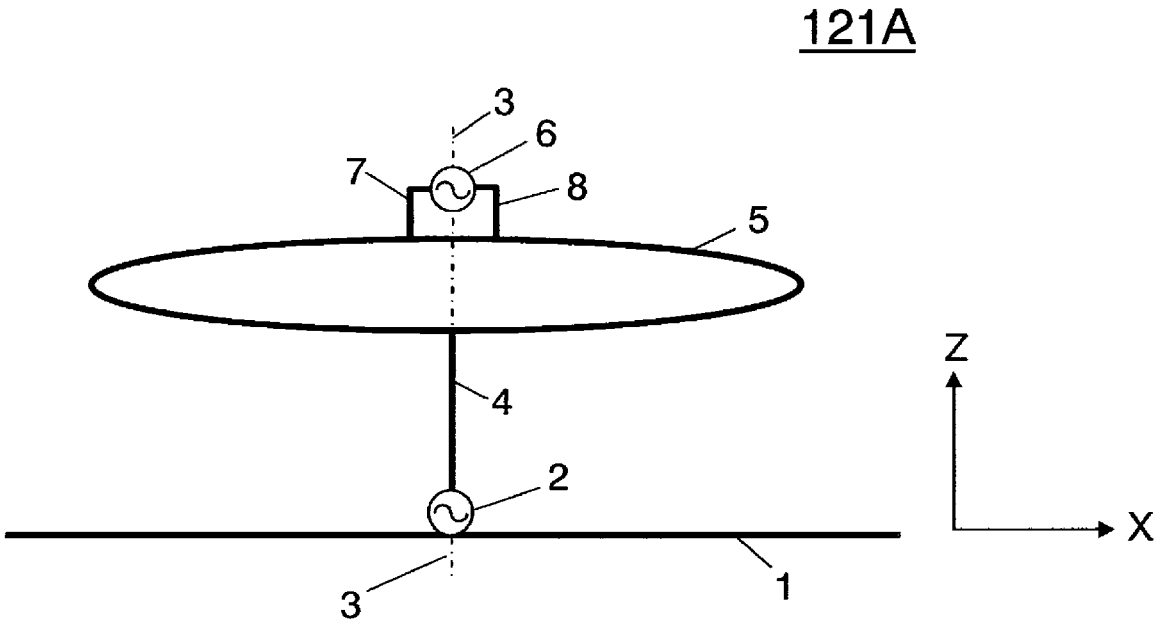
FIG. 21A is a sectional view showing a second composite antenna according to the fifteenth exemplary embodiment of the present invention.
Figure 21B:
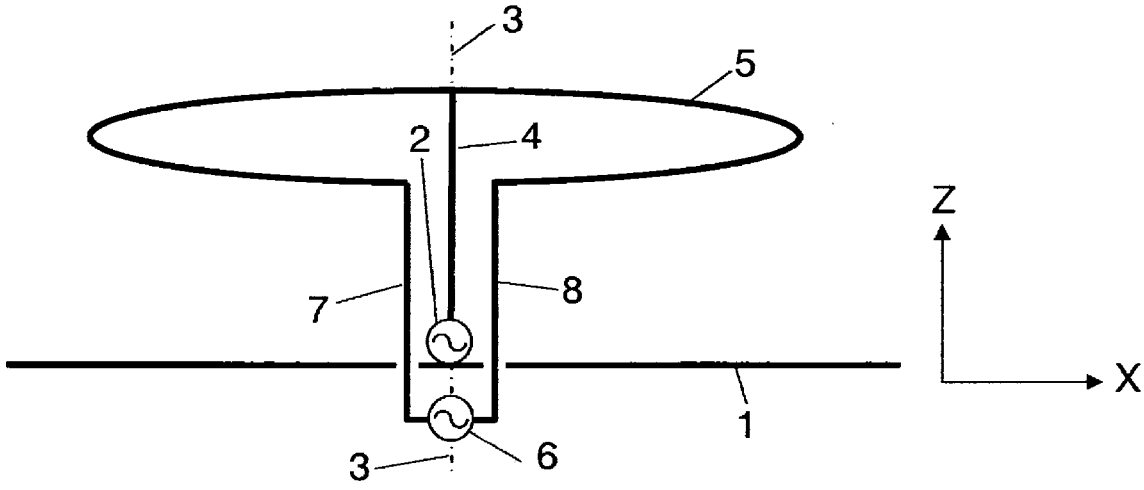
FIG. 21B is a sectional view showing a third composite antenna according to the fifteenth exemplary embodiment of the present invention.

FIG. 20, FIG. 21A and FIG. 21B are sectional views of composite antennas according to the fifteenth exemplary embodiment. These figures show structures as they are sectioned along their X-Z planes where second conductors 5 lie. Composite antenna 115 shown in this fifteenth exemplary embodiment basically provides similar advantageous effects as those of the ninth exemplary embodiment (in FIG. 12).

The fifteenth exemplary embodiment differs from the ninth exemplary embodiment mainly in respect of that second conductor 5 is formed into a quadrangular folded configuration as shown in FIG. 20. This configuration can lower a resonance frequency of the antenna when an electric power is fed through first feeding point 2, and hence achieve a reduction in size of the antenna. It can also improve a radiating resistance of the antenna when the electric power is fed through second feeding point 6, so as to achieve the wide band characteristic.

Beside the shape shown in FIG. 20, the folded configuration of second conductor 5 can provide the like advantageous effect even when it is altered to an oval-shape folded configuration as shown in FIG. 21A.

In any of the composite antennas shown in FIG. 20 and FIG. 21A, third conductor 7 and fourth conductor 8 are connected to one side of second conductor 5 opposite the other side where first conductor 4 is connected. However, third conductor 7 and fourth conductor 8 can be connected to the same side of second conductor 5 where first conductor 4 is connected. Such a configuration can still provide the advantageous effects similar to the above. For instance, a composite antenna of such a structure as illustrated in FIG. 21B can also provide similar advantageous effects as those of composite antennas 120 and 121A shown in FIG. 20 and FIG. 21A when an electric power is fed thereto.

Sixteenth Exemplary Embodiment

Figure 22:
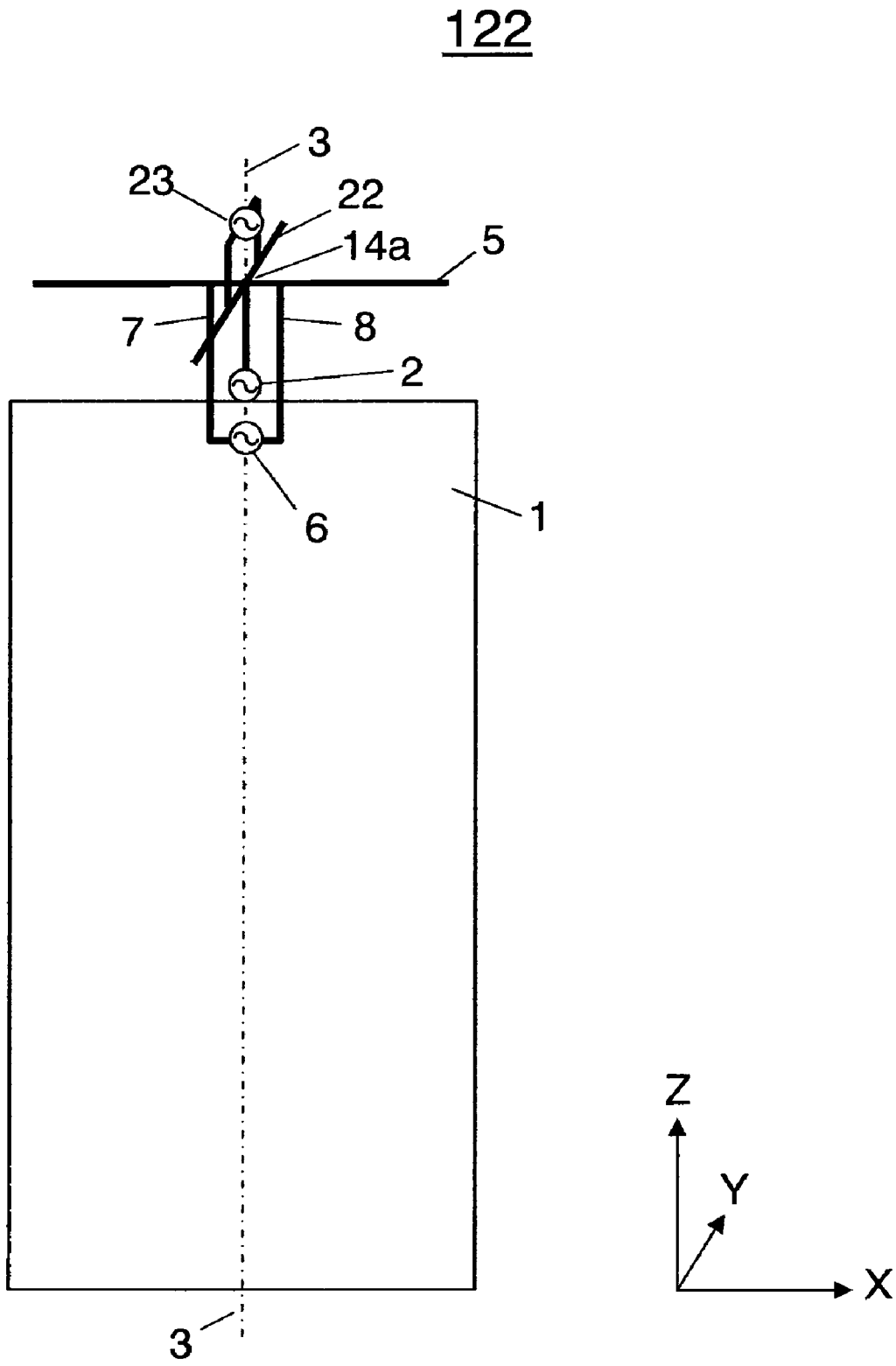
FIG. 22 is a perspective view showing a composite antenna according to a sixteenth exemplary embodiment of the present invention.

FIG. 22 is a perspective view of composite antenna 122 according to the sixteenth exemplary embodiment. The sixteenth exemplary embodiment differs from the ninth exemplary embodiment mainly in respects of that ground plane 1 is formed into a quadrangular flat plane having a linearly symmetric shape with respect to axis 3, and first feeding point 2 is connected to one side of ground plane 1, as shown in FIG. 22. In FIG. 22, second feeding point 6 is not connected to ground plane 1. Neither third conductor 7 nor fourth conductor 8 is connected to ground plane 1.

Adoption of this structure increases a radiating resistance of the antenna when an electric power is fed through first feeding point 2 since a current contributing to the radiation also flows in ground plane 1 (especially in the directions of ±Z-axis). This helps ease the impedance matching with other circuits and improves the radiation efficiency. A radiating pattern yielded in this exemplary embodiment is generally same as that of the ninth exemplary embodiment. This structure can also broaden a bandwidth of the antenna when the electric power is fed through the second feeding point, by changing a length of ground plane 1 in a manner to adjust its electrical length in the direction of Z-axis.

Ground plane 1 shown in FIG. 22 has the linearly symmetric shape with respect to axis 3. However, ground plane 1 needs not be linearly symmetric with respect to axis 3 to ensure the sufficient electrical isolation between first feeding point 2, second feeding point 6 and third feeding point 23 when the asymmetric shape is limited only to a portion of ground plane 1 where distribution of the current flow is low.

The composite antenna of the eighth exemplary embodiment is adaptable for a directional diversity antenna or a polarization diversity antenna of small size for use in a portable terminal and the like.

Seventeenth Exemplary Embodiment

Figure 23:
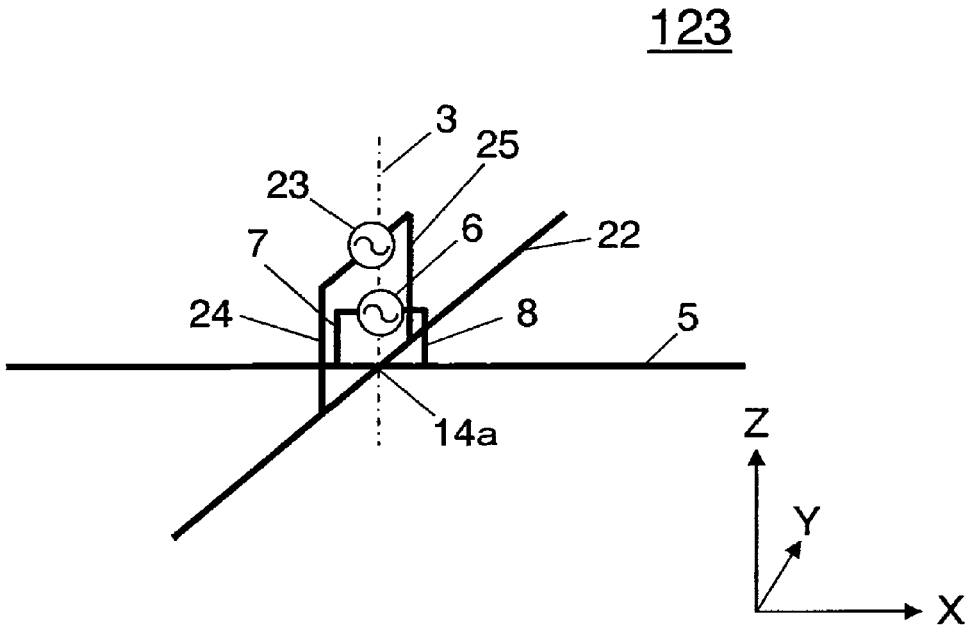
FIG. 23 is a perspective view showing a first composite antenna according to a seventeenth exemplary embodiment of the present invention.
Figure 24:
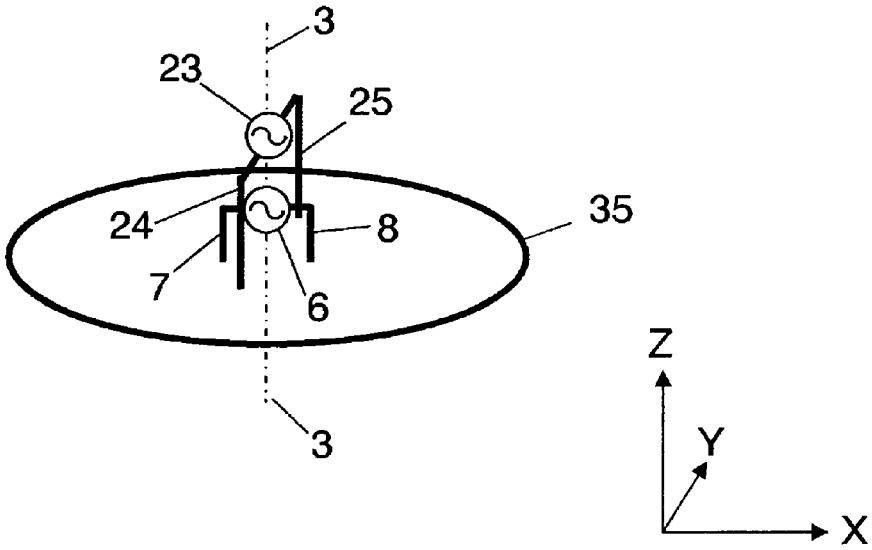
FIG. 24 is a perspective view showing a second composite antenna according to the seventeenth exemplary embodiment of the present invention.
Figure 25:
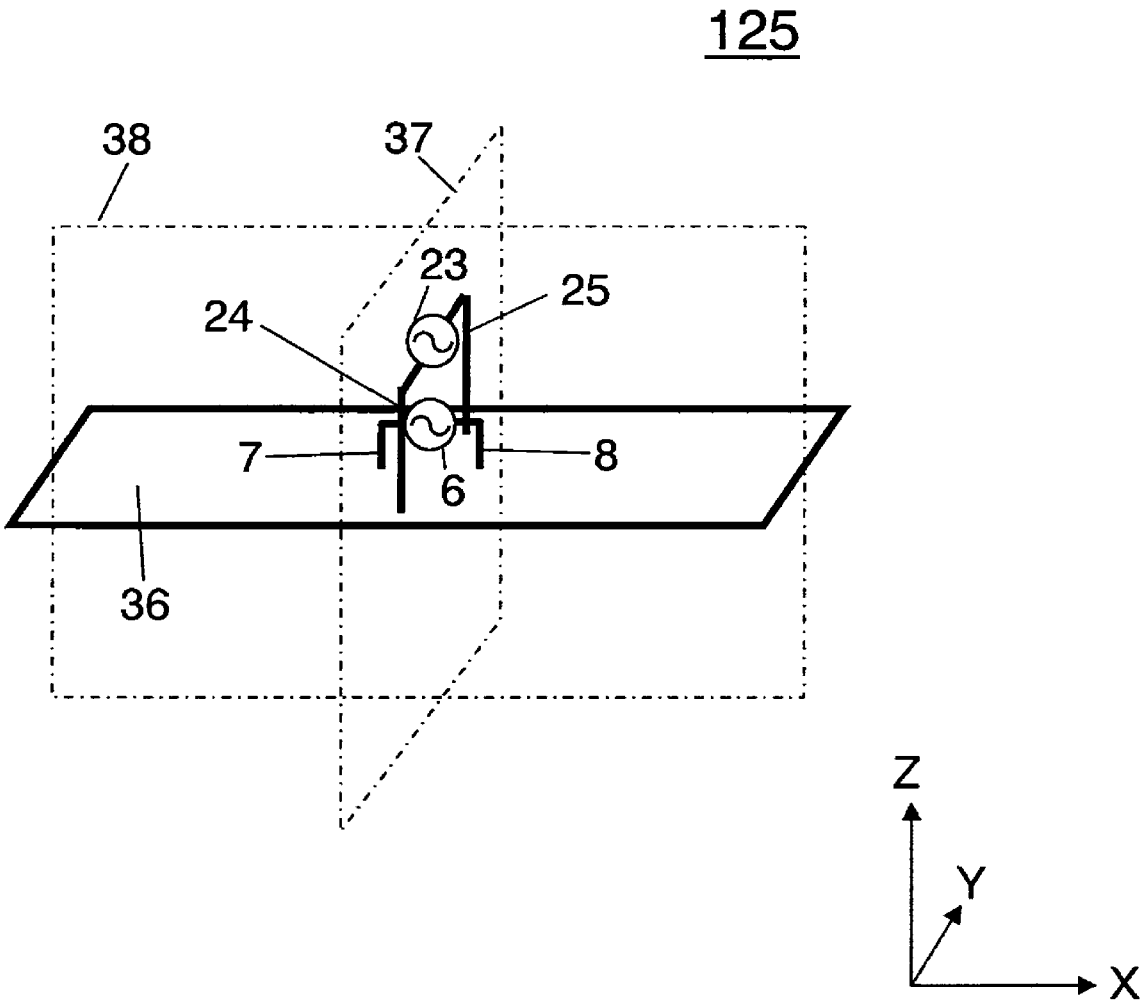
FIG. 25 is a perspective view showing a third composite antenna according to the seventeenth exemplary embodiment of the present invention.

FIG. 23, FIG. 24 and FIG. 25 are perspective views of composite antennas 123, 124 and 125 respectively according to the seventeenth exemplary embodiment. The seventeenth exemplary embodiment differs from the ninth exemplary embodiment mainly in respect of that the composite antenna is not provided with ground plane 1, first feeding point 2 and first conductor 4 shown in the ninth exemplary embodiment 9, as is apparent from FIG. 23.

Composite antenna 123 shown in this seventeenth exemplary embodiment has second conductor 5 and fifth conductor 22 defining the two antenna elements connected securely at generally the center portions thereof, so as to improve robustness of the antenna.

When electric powers are equally fed to the composite antenna through both second feeding point 6 and third feeding point 23 in a well-balanced manner, a voltage potential becomes nearly zero volt at junction 14*a* where second conductor 5 and fifth conductor 22 are connected directly. This can therefore obviate a drawback, in which the signal fed from second feeding point 6 leaks to fifth conductor 22. It also avoids a problem of electromagnetic coupling between second conductor 5 and fifth conductor 22, since second conductor 5 and fifth conductor 22 are disposed at right angles. This is because the polarizing orientations of second conductor 5 and fifth conductor 22 are orthogonal with respect to each other. Sufficient electrical isolation can therefore be ensured between second feeding point 6 and third feeding point 23.

FIG. 24 shows another composite antenna of this exemplary embodiment, in which a structural robustness is further improved from that of FIG. 23. Composite antenna 124 shown in FIG. 24 comprises round conductor 35 formed of a single conductor in place of second conductor 5 and fifth conductor 22. This structure can improve the physical strength of composite antenna 124. When an electric power is fed through third feeding point 23, a voltage potential on round conductor 35 becomes zero volt along a line that cresses two points where third conductor 7 and fourth conductor 8 are connected to round conductor 35. Similarly, when an electric power is fed through second feeding point 6, a voltage potential on round conductor 35 also becomes zero volt along another line that cresses two points where sixth conductor 24 and seventh conductor 25 are connected to round conductor 35. An electrical isolation can therefore be ensured sufficiently between second feeding point 6 and third feeding point 23.

FIG. 25 is composite antenna 125, in which round conductor 35 of the composite antenna in FIG. 24 is replaced with rectangular conductor 36. The composite antenna of FIG. 25 can also provide improvement of the physical strength like the composite antenna of FIG. 24. In addition, this composite antenna yields different resonance frequencies between second feeding point 6 and third feeding point 23 since rectangular conductor 36 has different electrical lengths between the directions of X-axis and Y-axis. This exemplary embodiment can thus achieve the composite antenna adaptable for use in two frequency bands.

INDUSTRIAL APPLICABILITY

Composite antennas and portable terminals of the present invention provide the advantageous effects of reducing their size while also ensuring proper electrical isolations. The composite antennas are especially useful as antennas for movable radio and telecommunications devices such as cellular phone antennas and vehicle-mounted antennas, downsizing of which is strongly demanded, and their industrial applicability is therefore very broad.

The invention claimed is:

1. A composite antenna comprising:

a ground plane;

a first feeding point connected to the ground plane;

a first conductor connected to the first feeding point and having any of a linearly symmetric configuration and a plane symmetric configuration or electrically symmetric with respect to an axis or a plane orthogonal to the ground plane; a second conductor connected to the first conductor and having any of a linearly symmetric configuration, a plane symmetric configuration and electrically symmetric with respect to the axis or the plan;

a second feeding point set at a given position in the axis or the plane;

a third conductor connecting the second feeding point and the second conductor; and a fourth conductor connecting the second feeding point and the second conductor and disposed in a manner that is linearly symmetric or plane symmetric or electrically symmetric to the third conductor with respect to the axis or the plane.

2. The composite antenna of claim 1, wherein the third conductor is connected to one end of the second conductor, and the fourth conductor is connected to the other end of the second conductor.

3. The composite antenna of claim 1 adapted to function as a circular polarization antenna according to a phase value of a signal fed to the first feeding point and a phase value of another signal fed to the second feeding point.

4. The composite antenna of claim 1, wherein the second conductor has such a configuration as resembling two sectors linked at the centers thereof.

5. The composite antenna of claim 1, wherein the second conductor has a loop configuration of one of square, oval or round in shape.

6. The composite antenna of claim 1, wherein the ground plane comprises a ground plate, and the first feeding point is connected to one side of the ground plate.

7. The composite antenna of claim 6, wherein the ground plate has generally a symmetric configuration with respect to any of the axis and the plane.

8. The composite antenna of claim 6 mountable to an upper portion of a windshield of a motor vehicle.

9. The composite antenna of claim 6 adapted for installation in a portable terminal.

10. A portable terminal having a composite antenna of claim 1 mounted to one side of a ground plate.

11. A composite antenna comprising:

a ground plane;

a first feeding point connected to the ground plane;

a first conductor connected to the first feeding point and having any of a linearly symmetric configuration, a plane symmetric configuration and a symmetric electrical characteristic with respect to an axis or a plane orthogonal to the ground plane;

a second feeding point;

a second conductor having any of a linearly symmetric configuration and a plane symmetric configuration with respect to a given axis in alignment with the second feeding point, and connected to the first conductor;

a third conductor connecting the second feeding point and the second conductor;

a fourth conductor connecting the second feeding point and the second conductor, and disposed generally in a linearly symmetrical manner to the third conductor with respect to the given axis;

a third feeding point set on the given axis;

a fifth conductor disposed in an orientation generally orthogonal to the second conductor, and having any of generally a linear symmetric configuration and a plane symmetric configuration with respect to the given axis;

a sixth conductor connecting the third feeding point and the fifth conductor; and a seventh conductor also connecting the third feeding point and the fifth conductor and disposed generally in a linearly symmetrical or plane symmetrical manner to the sixth conductor with respect to the given axis.

12. The composite antenna of claim 11, wherein the second conductor and the fifth conductor are connected directly.

13. The composite antenna of claim 11, wherein the second conductor and the fifth conductor are comprised of any of a round conductor and a regular polygonal conductor having "n" sides where "n" $=m\times2+2$, with m being an integer not smaller than 1.

14. The composite antenna of claim 11, wherein the second conductor and the fifth conductor are different from each other in their electrical lengths.

15. The composite antenna of claim 11, wherein the third conductor is connected to one end of the second conductor, and the fourth conductor is connected to the other end of the second conductor.

16. The composite antenna of claim 11, wherein the sixth conductor is connected to one end of the seventh conductor, and the seventh conductor is connected to another end of the fifth conductor.

17. The composite antenna of claim 11, the antenna being adapted to function as a circular polarization antenna by adjustment of a phase value of a signal fed to each of the feeding points.

18. The composite antenna of claim 11, wherein any of the second conductor and the fifth conductor has a loop configuration of one of square, oval and round in shape.

19. The composite antenna of claim 11, wherein the first feeding point is disposed at one end of a ground plate.

20. The composite antenna of claim 19, wherein the ground plate has a symmetric shape with respect to the axis.

21. A composite antenna comprising:

a ground plane;

a first feeding point connected to the ground plane;

a first conductor connected to the first feeding point and having any of a linearly symmetric configuration, a plane symmetric configuration and electrical symmetry with respect to an axis or a plane orthogonal to the ground plane;

a second feeding point;

a second conductor having a symmetry in electrical characteristic with respect to a given axis in alignment with the second feeding point, and connected to the first conductor;

a third conductor connecting the second feeding point and the second conductor;

fourth conductor connecting the second feeding point and the second conductor, and disposed symmetrically in electric characteristic to the third conductor with respect to the given axis;

a third feeding point set on the given axis;

a fifth conductor disposed in an orientation generally orthogonal to the second conductor, and having a symmetry in electrical characteristic with respect to the given axis;

a sixth conductor connecting the third feeding point and the fifth conductor; and a seventh conductor also connecting the third feeding point and the fifth conductor, and disposed symmetrically in electric characteristic to the sixth conductor with respect to the given axis.

22. A portable terminal equipped with a composite antenna of claim 11.

23. The composite antenna of claim 21, wherein the second conductor and the fifth conductor are connected directly.

24. The composite antenna of claim 21, wherein the third conductor is connected to one end of the second conductor, and the fourth conductor is connected to the other end of the second conductor.

25. The composite antenna of claim 21, wherein the sixth conductor is connected to one end of the seventh conductor, and the seventh conductor is connected to another end of the fifth conductor.

26. The composite antenna of claim 21, the antenna being adapted to function as a circular polarization antenna by adjustment of a phase value of a signal fed to each of the feeding points.

27. The composite antenna of claim 21, wherein any of the second conductor and the fifth conductor has a loop configuration of one of square, oval and round in shape.

28. The composite antenna of claim 21, wherein the first feeding point is disposed at one end of a ground plate.

29. The composite antenna of claim 28, wherein the ground plate has a symmetric shape with respect to the axis.

30. A portable terminal equipped with a composite antenna of claim 21.

* * * * *

UNITED STATES PATENT AND TRADEMARK OFFICE

CERTIFICATE OF CORRECTION

PATENT NO. : 7,830,329 B2
APPLICATION NO. : 12/066968
DATED : November 9, 2010
INVENTOR(S) : Susumu Fukushima et al.

It is certified that error appears in the above-identified patent and that said Letters Patent is hereby corrected as shown below:

In column 13, line 26 please delete "+Y-axis" and insert therefor --±Y-axis--.

Signed and Sealed this
Twenty-second Day of February, 2011

David J. Kappos

David J. Kappos
*Director of the United States Patent and Trademark Office*